US010629213B2

(12) United States Patent
Rafii et al.

(10) Patent No.: US 10,629,213 B2
(45) Date of Patent: Apr. 21, 2020

(54) METHODS AND APPARATUS TO PERFORM WINDOWED SLIDING TRANSFORMS

(71) Applicant: The Nielsen Company (US), LLC, New York, NY (US)

(72) Inventors: Zafar Rafii, Berkeley, CA (US); Markus Cremer, Orinda, CA (US); Bongjun Kim, Evanston, IL (US)

(73) Assignee: The Nielsen Company (US), LLC, New York, NY (US)

( * ) Notice: Subject to any disclaimer, the term of this patent is extended or adjusted under 35 U.S.C. 154(b) by 16 days.

(21) Appl. No.: 15/942,369

(22) Filed: Mar. 30, 2018

(65) Prior Publication Data

US 2019/0122678 A1 Apr. 25, 2019

Related U.S. Application Data

(63) Continuation-in-part of application No. 15/899,220, filed on Feb. 19, 2018, and a continuation-in-part of application No. 15/793,543, filed on Oct. 25, 2017.

(51) Int. Cl.

| | |
|---|---|
| ***G10L 19/02*** | (2013.01) |
| ***G10L 25/51*** | (2013.01) |
| *G10L 19/22* | (2013.01) |

(52) U.S. Cl.

CPC ..... *G10L 19/02* (2013.01); *G10L 25/51* (2013.01); *G10L 19/0212* (2013.01); *G10L 19/22* (2013.01)

(58) Field of Classification Search

CPC ..... G10L 25/21; G10L 19/005; G10L 19/018; G10L 19/02

See application file for complete search history.

(56) References Cited

U.S. PATENT DOCUMENTS

| | | | |
|---|---|---|---|
| 5,373,460 | A | 12/1994 | Marks, II |
| 6,820,141 | B2 | 11/2004 | Bennett |

(Continued)

FOREIGN PATENT DOCUMENTS

| | | |
|---|---|---|
| GB | 2474508 | 4/2011 |
| WO | 2019084065 A1 | 5/2019 |

OTHER PUBLICATIONS

Jenner, Frank, and Andres Kwasinski. "Highly accurate non-intrusive speech forensics for codec identifications from observed decoded signals." 2012 IEEE International Conference on Acoustics, Speech and Signal Processing (ICASSP). IEEE, 2012. (Year: 2012).*

(Continued)

*Primary Examiner* — Brian L Albertalli
(74) *Attorney, Agent, or Firm* — Hanley, Flight & Zimmerman, LLC

(57) ABSTRACT

Methods and apparatus to perform windowed sliding transforms are disclosed. An example apparatus includes a coding format identifier to identify, from a received first audio signal representing a decompressed second audio signal, an audio compression configuration used to compress a third audio signal to form the second audio signal, a source identifier to identify a source of the second audio signal based on the identified audio compression configuration, a windowed sliding transformer to perform a first time-frequency analysis of a first block of the first audio signal according to a first trial compression configuration, and perform a second time-frequency analysis of the first block of the first audio signal according to a second trial compression configuration, wherein the windowed sliding transformer includes a multiplier to multiply a vector including a first frequency-domain representation and a matrix including a third frequency-domain representation, an artifact computer to determine a first compression artifact resulting (Continued)

from the first time-frequency analysis, and determine a second compression artifact resulting from the second time-frequency analysis; and a controller to select between the first trial compression configuration and the second trial compression configuration as the audio compression configuration based on the first compression artifact and the second compression artifact.

19 Claims, 14 Drawing Sheets

(56) References Cited

U.S. PATENT DOCUMENTS

| | | | | |
|---|---|---|---|---|
| 7,742,737 | B2 | 6/2010 | Peiffer et al. | |
| 7,907,211 | B2 | 3/2011 | Oostveen et al. | |
| 8,351,645 | B2 | 1/2013 | Srinivasan | |
| 8,553,148 | B2 | 10/2013 | Ramaswamy et al. | |
| 8,559,568 | B1 | 10/2013 | Clark | |
| 8,639,178 | B2 | 1/2014 | Anniballi et al. | |
| 8,768,713 | B2 | 7/2014 | Chaoui et al. | |
| 8,825,188 | B2 * | 9/2014 | Stone | H04S 3/00 381/2 |
| 8,856,816 | B2 | 10/2014 | Falcon | |
| 9,049,496 | B2 | 6/2015 | Raesig et al. | |
| 9,313,359 | B1 | 4/2016 | Stojancic et al. | |
| 9,456,075 | B2 | 9/2016 | Ponting et al. | |
| 9,515,904 | B2 | 12/2016 | Besehanic et al. | |
| 9,641,892 | B2 | 5/2017 | Panger et al. | |
| 9,648,282 | B2 * | 5/2017 | Petrovic | H04H 20/14 |
| 9,837,101 | B2 | 12/2017 | Bilobrov | |
| 2003/0026201 | A1 | 2/2003 | Arnesen | |
| 2003/0086341 | A1 | 5/2003 | Wells et al. | |
| 2005/0015241 | A1 | 1/2005 | Baum | |
| 2006/0025993 | A1 | 2/2006 | Aarts et al. | |
| 2008/0169873 | A1 | 7/2008 | Toda | |
| 2014/0137146 | A1 | 5/2014 | Topchy et al. | |
| 2014/0336800 | A1 * | 11/2014 | Radhakrishnan | G10L 25/06 700/94 |
| 2015/0170660 | A1 | 6/2015 | Han et al. | |
| 2015/0222951 | A1 | 8/2015 | Ramaswamy | |
| 2015/0302086 | A1 | 10/2015 | Roberts et al. | |
| 2016/0196343 | A1 | 7/2016 | Rafii | |
| 2017/0048641 | A1 | 2/2017 | Franck | |
| 2017/0337926 | A1 | 11/2017 | Chon et al. | |
| 2018/0315435 | A1 | 11/2018 | Goodwin et al. | |
| 2018/0365194 | A1 | 12/2018 | Grado et al. | |
| 2019/0122673 | A1 | 4/2019 | Rafii et al. | |
| 2019/0139559 | A1 | 5/2019 | Rafii et al. | |

OTHER PUBLICATIONS

Korycki, Rafal. "Authenticity examination of compressed audio recordings using detection of multiple compression and encoders' identification." Forensic science international 238 (2014): 33-46. (Year: 2014).*

Todd et al., "AC-3: Flexible Perceptual Coding for Audio Transmission and Storage", presented at the 96th Convention of the Audio Engineering Society, Feb. 26-Mar. 1, 1994, 13 pages.

Brandenburg et al.,"ISO-MPEG-1 Audio: A Generic Standard for Coding of High-Quality Digital Audio", presented at the 92 Convention of the Audio Engineering Society, 1992; revised Jul. 15, 1994, 13 pages.

Brandenburg, Karlheinz, "MP3 and AAC Explained", presented at the Audio Engineering Society's 17th International Conference on High Quality Audio Coding, Sep. 2-5, 1999, 12 pages.

Herre et al., "Analysis of Decompressed Audio—The "Inverse Decoder"", presented at the 109th Convention of the Audio Engineering Society, Sep. 22-25, 2000, 24 pages.

Moehrs et al., "Analysing decompressed audio with the "Inverse Decoder"—towards an operative algorithm", presented at the 112the Convention of the Audio Engineering Society, May 10-13, 2002, 22 pages.

Bosi et al., "Introduction to Digital Audio Coding and Standards", published by Kluwer Academic Publishers, 2003, 426 pages.

Yang et al., "Detecting Digital Audio Forgeries by Checking Frame Offsets", presented at the 10th annual ACM Multimedia & Security Conference, Sep. 22-23, 2008, 6 pages.

D'Alessandro et al., "MP3 Bit Rate Quality Detection through Frequency Spectrum Analysis", presented at the 11th annual ACM Multimedia & Security Conference, Sep. 7-8, 2009, 5 pages.

Yang et al., "Defeating Fake-Quality MP3", presented at the 11th annual ACM Multimedia & Security Conference, Sep. 7-8, 2009, 8 pages.

Liu et al., "Detection of Double MP3 Compression", published in Cognitive Computation, May 22, 2010, 6 pages.

Hiçsönmez et al., "Audio Codec Identification Through Payload Sampling", published in Information Forensics and Security (WIFS), 2011, 6 pages.

Advanced Television Systems Committee, "ATSC Standard: Digital Audio Compression (AC-3, E-AC-3)", Dec. 17, 2012, 270 pages.

Hiçsönmez et al., "Methods for Identifying Traces of Compression in Audio", published online, URL: https://www.researchgate.net/publication/26199644, May 1, 2014, 7 pages.

Bianchi et al., "Detection and Classification of Double Compressed MP3 Audio Tracks", presented at the 1st annual AMC workshop on Information Hiding & Multimedia Security, Jun. 17-19, 2013, 6 pages.

Qiao et al., "Improved Detection of MP3 Double Compression using Content-Independent Features", published in Signal Processing, Communication and Computing (ICSPCC), 2013, 4 pages.

Korycki, Rafal, "Authenticity examination of compressed audio recordings using detection of multiple compression and encoders' identification", published in Forensic Science International, Februray 7, 2014, 14 pages.

Gärtner et al., "Efficient Cross-Codec Framing Grid Analysis for Audio Tampering Detection", presented at the 136th Audio Engineering Society Convention, Apr. 26-29, 2014, 11 pages.

Luo et al., "Identifying Compression History of Wave Audio and Its Applications", published in ACM Transactions on Multimedia Computing, Communications and Applications, vol. 10, No. 3, Article 30, Apr. 2014, 19 pages.

xiph.org Foundation, "Vorbis I Specification", published Feb. 27, 2015, 74 pages.

Seichter et al., "AAC Encoding Detection and Bitrate Estimation Using a Convolutional Neural Network", published in Acoustics, Speech and Signal Processing (ICASSP), 2016, 5 pages.

Hennequin et al., "Codec Independent Lossy Audio Compression Detection", published in Accoustics, Speech and Signal Processing (ICASSP), 2017, 5 pages.

Kim et al., "Lossy Compression Identification from Audio Recordings, version 1", 5 pages.

Kim et al., "Lossy Compression Identification from Audio Recordings, version 2", 5 pages.

Barry Van Oudtshoorn, "Investigating the Feasibility of Near Real-Time Music Transcription on Mobile Devices," Honours Programme of the School of Computer Science and Software enginnering, The University of Western Australia, 2008, 50 pages.

Eric Jacobsen and Richard Lyons, "Sliding Spectrum Analysis," Streamlining digital Signal Processing: A Tricks of the Trade Guidebook, IEEE, Chapter 14, 2007, 13 pages.

Eric Jacobsen and Richard Lyons, "An update to the sliding DFT," IEEE Signal Processing Magazine, 2004, 3 pages.

Eric Jacobsen and Richard Lyons, "The Sliding DFT," IEEE Signal Processing Magazine, 1053-5888, Mar. 2003, p. 74-80, 7 pages.

Haitham Hassanieh, Piotr Indyk, Dina Katabi, and Eric Price, "Simple and Practical Algorithm for Sparse Fourier Transform," SODA '12 Proceedings of the Twenty-Third Annual Symposium on Discrete Algorithms, 12 pages.

Judith C. Brown and Miller S. Puckette, "An efficient algorithm for the calculation of a constant Q transform," J. Acoust. Soc. Am. 92 (5), Nov. 1992, pp. 2698-2701, 4 pages.

Judith C. Brown, "Calculation of a constant Q spectral transform," J. Acoust. Soc. Am. 89 (1), Jan. 1991, pp. 425-434, 10 pages.

(56) References Cited

OTHER PUBLICATIONS

Steve Arar, "DFT Leakage and the Choice of the Window Function," Aug. 23, 2017, retrieved from www.allaboutcircuits.com/technical-articles, 11 pages.
Tom Springer, "Sliding FFT computes frequency spectra in real time," EDN Magazine, Sep. 29, 1988, reprint taken from Electronic Circuits, Systems and Standards: The Best of EDN, edited by Ian Hickman, 1991, 7 pages.
Kim et al., "Lossy Audio Compression Identification," 26th European Signal Processing Conference (EUSIPCO 2018), Rome, Italy, Sep. 3-7, 2018 (5 pages).
Kim et al., "Lossy Audio Compression Identification," 26th European Signal Processing Conference (EUSIPCO 2018), Rome, Italy, Sep. 3-7, 2018 (1 page).
United States Patent and Trademark Office, "Non-Final Office Action," dated May 20, 2019 in connection with U.S. Appl. No. 15/899,220 (10 pages).
International Searching Authority, "International Search Report," issued in connection with application No. PCT/US2018/057183, dated Feb. 13, 2019, 5 pages.
International Searching Authority, "Written Opinion," issued in connection with application No. PCT/US2018/057183, dated Feb. 13, 2019, 4 pages.
United States Patent and Trademark Office, "Non-Final Office Action," dated Feb. 26, 2019, in connection with U.S. Appl. No. 15/793,543 (14 pages).
United States Patent and Trademark Office, "Final Office Action," dated Jul. 12, 2019, in connection with U.S. Appl. No. 15/793,543 (14 pages).
Hicsonmez et al. "Audio Codec Identification from Coded and Transcoded Audios," Digital Signal Processing vol. 23, 2013: pp. 1720-1730 (11 pages).
Luo et al., "Identification of AMR decompressed audio," Digital Signal Processing vol. 37, 2015: pp. 85-91 (7 pages).
United States Patent and Trademark Office, "Final Office Action," issued in connection with U.S. Appl. No. 15/899,220, dated Nov. 25, 2019, 18 pages.
United States Patent and Trademark Office, "Notice of Allowance," issued in connection with U.S. Appl. No. 15/899,220, dated Feb. 11, 2020, 18 pages.

* cited by examiner

METHODS AND APPARATUS TO PERFORM WINDOWED SLIDING TRANSFORMS

RELATED APPLICATIONS

This patent arises from a continuation-in-part of U.S. patent application Ser. No. 15/793,543, which was filed on Oct. 25, 2017; and arises from a continuation-in-part of U.S. patent application Ser. No. 15/899,220, which was filed on Feb. 19, 2018. U.S. patent application Ser. No. 15/793,543 and U.S. patent application Ser. No. 15/899,220 are hereby incorporated by reference in their entirety. Priority to U.S. patent application Ser. Nos. 15/793,543 and 15/899,220 are hereby claimed.

FIELD OF THE DISCLOSURE

This disclosure relates generally to transforms, and, more particularly, to methods and apparatus to identify sources of network streaming services using windowed sliding transforms.

BACKGROUND

The sliding discrete Fourier transform (DFT) is a method for efficiently computing the N-point DFT of a signal starting at sample m using the N-point DFT of the same signal starting at the previous sample m−1. The sliding DFT obviates the conventional need to compute a whole DFT for each starting sample.

Figure 1:
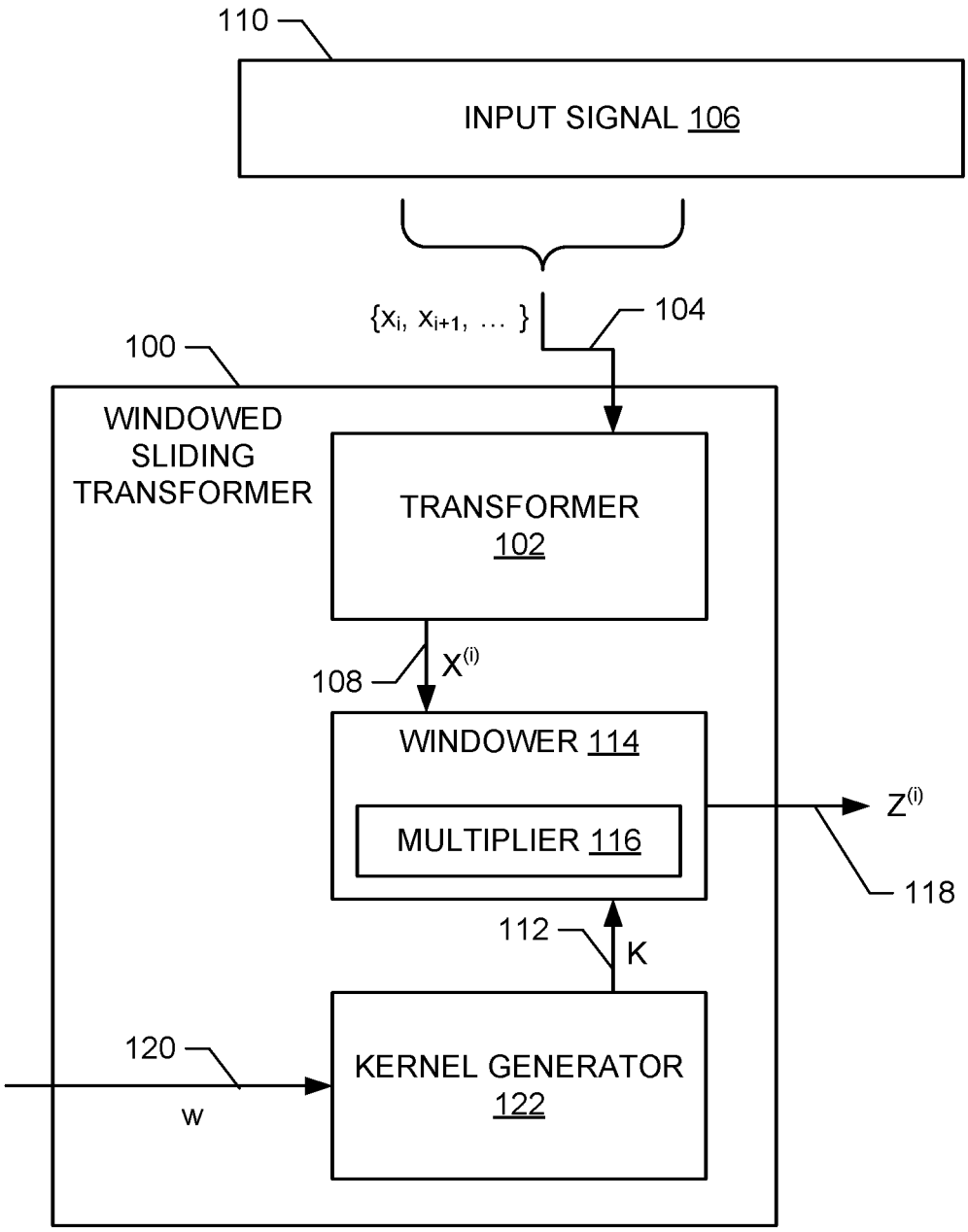
FIG. 1 illustrates an example windowed sliding transformer constructed in accordance with teachings of this disclosure.

In general, the same reference numbers will be used throughout the drawing(s) and accompanying written description to refer to the same or like parts. Connecting lines and/or connections shown in the various figures presented are intended to represent example functional relationships, physical couplings and/or logical couplings between the various elements.

DETAILED DESCRIPTION

Sliding transforms are useful in applications that require the computation of multiple DFTs for different portions, blocks, etc. of an input signal. For example, sliding transforms can be used to reduce the computations needed to compute transforms for different combinations of starting samples and window functions. For example, different combinations of starting samples and window functions can be used to identify the compression scheme applied to an audio signal as, for example, disclosed in U.S. patent application Ser. No. 15/793,543, filed on Oct. 25, 2017. The entirety of U.S. patent application Ser. No. 15/793,543 is incorporated herein by reference. Conventional solutions require that an entire DFT be computed after each portion of the input signal has had a window function applied. Such solutions are computationally inefficient and/or burdensome. In stark contrast, windowed sliding transformers are disclosed herein that can obtain the computational benefit of sliding transforms even when a window function is to be applied.

Reference will now be made in detail to non-limiting examples, some of which are illustrated in the accompanying drawings.

Figure 2:
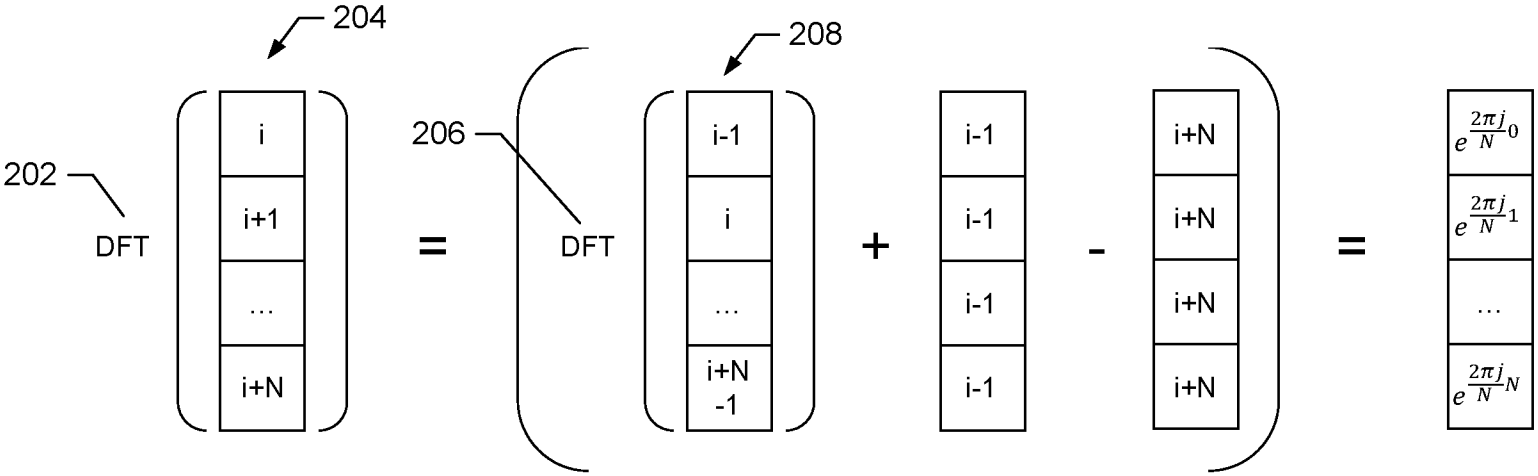
FIG. 2 illustrates an example operation of the example transformer of FIG. 1.

FIG. 1 illustrates an example windowed sliding transformer 100 constructed in accordance with teachings of this disclosure. To compute a transform (e.g., a time-domain to frequency-domain transform), the example windowed sliding transformer 100 of FIG. 1 includes an example transformer 102. The example transformer 102 of FIG. 1 computes a transform of a portion 104 (e.g., a block, starting with a particular sample, etc.) of an input signal 106 (e.g., of time-domain samples) to form a transformed representation 108 (e.g., a frequency-domain representations) of the portion 104 of the input signal 106. Example input signals 106 include an audio signal, an audio portion of a video signal, etc. Example transforms computed by the transformer 102 include, but are not limited to, a DFT, a sliding DFT, a modified discrete cosine transform (MDCT)), a sliding MDCT, etc. In some examples, the transforms are computed by the transformer 102 using conventional implementations of transforms. For example, the sliding N-point DFT $X^{(i)}$ 108 of an input signal x 106 starting from sample i from the N-point DFT $X^{(i-1)}$ of the input signal x 106 starting from sample i−1 can be expressed mathematically as:

$$\underset{0 \le k < N}{X_k^{(i)}} = (X_k^{(i-1)} - x_{i-1} + x_{i+n-1})e^{\frac{j2\pi k}{N}}, \quad \text{EQN (1)}$$

where the coefficients $$e^{\frac{2j\pi k}{N}}$$

are fixed values. An example operation of the example transformer 102 of FIG. 1 implemented the example sliding DFT of EQN (1) is shown in FIG. 2. As shown in FIG. 2, a first frequency-domain representation DFT $X^{(i)}$ 202 of a first block of time domain samples 204 $\{x_i, \ldots x_{i+N}\}$ is based on the second frequency-domain representation DFT $X^{(i-1)}$ 206 of a second block of time domain samples 208 $\{x_{i-1} \ldots x_{i+N-1}\}$, Conventionally, the DFT $Z^{(i)}$ of a portion of an input signal x after the portion has been windowed with a window function w is computed using the following mathematical expression:

$$\underset{0 \le k < N}{Z_k^{(i)}} = \sum_{n=0}^{N-1} x_{i+n} w_n e^{\frac{-j2\pi nk}{N}}. \quad \text{EQN (2)}$$

Accordingly, an entire DFT must be computed for each portion of the input signal in known systems.

In some examples, the input signal 106 is held (e.g., buffered, queued, temporarily held, temporarily stored, etc.) for any period of time in an example buffer 110.

When EQN (2) is rewritten according to teachings of this disclosure using Parseval's theorem, as shown in the mathematical expression of EQN (3), the window function w is expressed as a kernel $K_{k,k'}$ 112, which can be applied to the transformed representation $X^{(i)}$ 108 of the portion 104.

$$\underset{0 \le k < N}{Z_k^{(i)}} = \sum_{k'=0}^{N-1} X_{k'}^{(i)} X_{k,k'}. \quad \text{EQN (3)}$$

In EQN (3), the transformed representation $X^{(i)}$ 108 of the portion 104 can be implemented using the example sliding DFT of EQN (1), as shown in EQN (4).

$$\underset{0 \le k < N}{Z_k^{(i)}} = \sum_{k'=0}^{N-1} \left[(X_{k'}^{(i-1)} - x_{i-1} + x_{i+n-1})e^{\frac{j2\pi k'}{N}}\right] K_{k,k'}, \quad \text{EQN (4)}$$

where the coefficients $$e^{\frac{2j\pi k}{N}}$$

and the kernel $K_{k,k'}$ 112 are fixed values. In stark contrast to conventional solutions, using EQN (4) obviates the requirement for a high-complexity transform to be computed for each portion of the input. In stark contrast, using EQN (4), a low-complexity sliding transform together with a low-complexity application of the kernel $K_{k,k'}$ 112 is provided.

Figure 3:
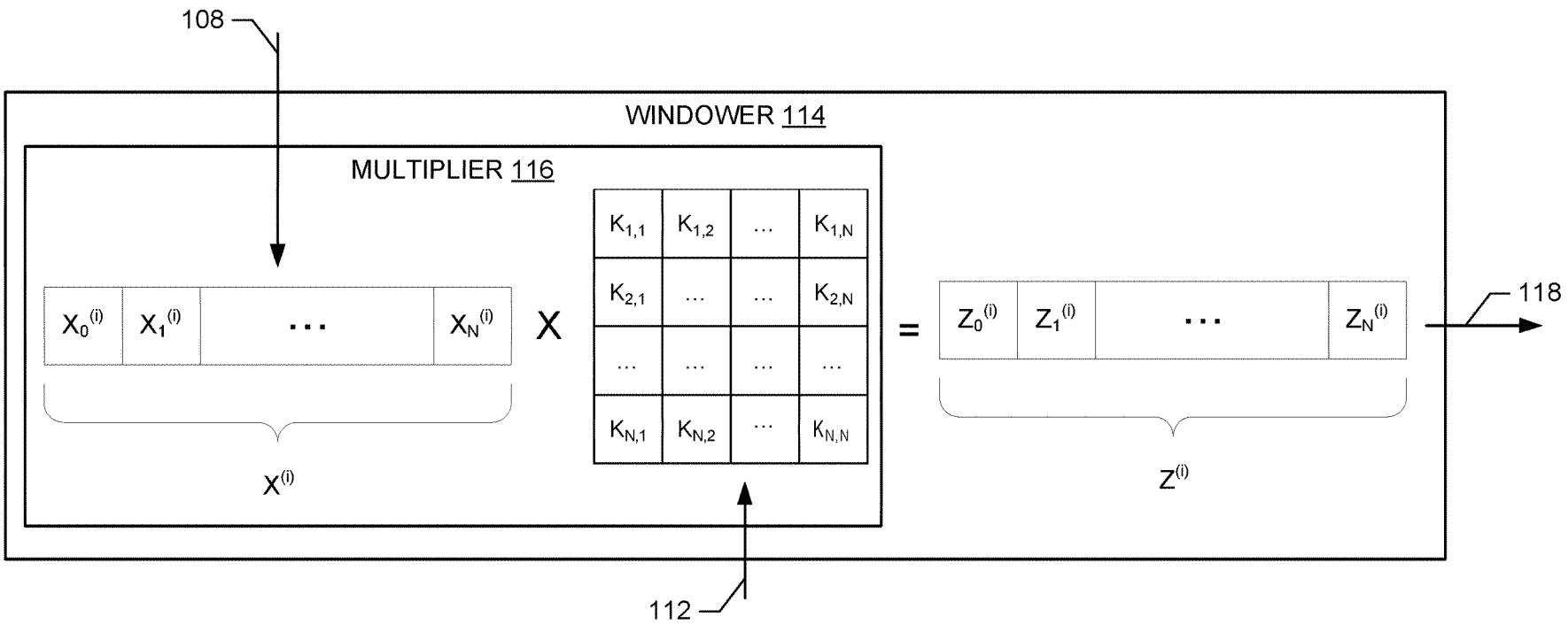
FIG. 3 illustrates an example operation of the example windower of FIG. 1.

To window the transformed representation 108, the example windowed sliding transformer 100 of FIG. 1 includes an example windower 114. The example windower 114 of FIG. 1 applies the kernel $K_{k,k'}$ 116 to the transformed representation 108 to form windowed transformed data 118 (e.g., spectrograms). As shown in EQN (3) and EQN (4), in some examples, the windower 114 applies the kernel $K_{k,k'}$ 116 using an example multiplier 116 that performs a matrix multiplication of the transformed representation $X_{(i)}$ 108 of the portion 104 with the kernel $K_{k,k'}$ 112, as shown in the example graphical depiction of FIG. 3.

To window the transformed representation 108, the example windowed sliding transformer 100 of FIG. 1 includes an example windower 114. The example windower 114 of FIG. 1 applies a kernel 112 to the transformed representation 108 to form windowed transformed data 118. Conventionally, a DFT of the portion 104 after it has been windowed with a window function 120 would be computed, as expressed mathematically below in EQN (2)). When the sliding DFT of EQN (1) is substituted into the mathematical expression of EQN (3), the combined operations of the transformer 102 and the windower 114 can be expressed mathematically as:

$$\underset{0 \le k < N}{Z_k^{(i)}} = \sum_{k'=0}^{N-1} \left[(X_{k'}^{(i-1)} - x_{i-1} + x_{i+n-1})e^{\frac{j2\pi k'}{N}}\right] K_{k,k'}, \quad \text{EQN (4)}$$

where the coefficients $$e^{\frac{2j\pi k}{N}}$$

and $K_{k,k'}$ are fixed values.

To compute the kernel 112, the example windowed sliding transformer 100 includes an example kernel generator 122. The example kernel generator 122 of FIG. 1 computes the kernel 112 from the window function 120. In some examples, the kernel generator 122 computes the kernel $K_{k,k'}$ 112 using the following mathematical expression:

$$\underset{\substack{0 \le k < N \\ 0 \le k' < N}}{K_{k,k'}} = \frac{1}{N}\overline{\mathcal{F}\left(\overline{w_n} e^{\frac{j2\pi nk}{N}}\right)}, \quad \text{EQN (5)}$$

where $\mathcal{F}(\,)$ is a Fourier transform. The kernel $K_{k,k'}$ 112 is a frequency-domain representation of the window function w 120. The example windower 114 applies the frequency-domain representation $K_{k,k'}$ 112 to the frequency-domain representation $X^{(i)}$ 108. The kernel $K_{k,k'}$ 112 needs to be computed only once and, in some examples is sparse. Accordingly, not all of the computations of multiplying the transformed representation $X^{(i)}$ and the kernel $K_{k,k'}$ 112 in EQN (3) and EQN (4) need to be performed. In some examples, the sparseness of the kernel $K_{k,k'}$ 112 is increased by only keeping values that satisfy (e.g., are greater than) a threshold. Example windows 120 include, but are not limited to, the sine, slope and Kaiser-Bessel-derived (KBD) windows.

References have been made above to sliding windowed DFT transforms. Other forms of sliding windowed transforms can be implemented. For example, the sliding N-point MDCT $Y^{(i)}$ 108 of an input signal x 106 starting from sample i from the N-point DFT $X^{(i-1)}$ of the input signal x 106 starting from sample i−1 can be expressed mathematically as:

$$Y_k^{(i)} \quad 0 \le k < \frac{N}{2} = \sum_{k'=0}^{N-1} \left[ (X_{k'}^{(i-1)} - x_{i-1} + x_{i+n-1}) e^{\frac{j2\pi k'}{N}} \right] K_{k,k'}, \qquad \text{EQN (6)}$$

where the kernel $K_{k,k'}$ 112 is computed using the following mathematical expression:

$$K_{k,k'} \quad 0 \le k < N/2,\ 0 \le k' < N = \frac{1}{N} \overline{DFT\left( \overline{w_n} \cos\left[ \frac{j2\pi}{N} \left( n + \frac{1}{2} + \frac{N}{4} \right) \left( k + \frac{1}{2} \right) \right] \right)}, \qquad \text{EQN (7)}$$

In another example, the sliding N-point complex MDCT $\mathcal{Z}^{(i)}$ 108 of an input signal x 106 starting from sample i from the N-point DFT $X^{(i-1)}$ of the input signal x 106 starting from sample i−1 can be expressed mathematically as:

$$Z_k^{(i)} \quad 0 \le k < \frac{N}{2} = \sum_{k'=0}^{N-1} \left[ (X_{k'}^{(i-1)} - x_{i-1} + x_{i+n-1}) e^{\frac{j2\pi k'}{N}} \right] K_{k,k'}, \qquad \text{EQN (8)}$$

where the kernel $K_{k,k'}$ 112 is computed using the following mathematical expression:

$$K_{k,k'} \quad 0 \le k < N/2,\ 0 \le k' < N = \frac{1}{N} \overline{DFT\left( \overline{w_n} e^{\frac{j2\pi}{N}\left(n + \frac{1}{2} + \frac{N}{4}\right)\left(k + \frac{1}{2}\right)} \right)}, \qquad \text{EQN (9)}$$

While an example manner of implementing the example windowed sliding transformer 100 is illustrated in FIGS. 1 and 2, one or more of the elements, processes and/or devices illustrated in FIGS. 1 and 2 may be combined, divided, re-arranged, omitted, eliminated and/or implemented in any other way. Further, the example transformer 102, the example windower 114, the example multiplier 116, the example kernel generator 122 and/or, more generally, the example windowed sliding transformer 100 of FIGS. 1 and 2 may be implemented by hardware, software, firmware and/or any combination of hardware, software and/or firmware. Thus, for example, any of the example transformer 102, the example windower 114, the example multiplier 116, the example kernel generator 122 and/or, more generally, the example windowed sliding transformer 100 could be implemented by one or more analog or digital circuit(s), logic circuits, programmable processor(s), programmable controller(s), graphics processing unit(s) (GPU(s)), digital signal processor(s) (DSP(s)), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example transformer 102, the example windower 114, the example multiplier 116, the example kernel generator 122 and/or the example windowed sliding transformer 100 is/are hereby expressly defined to include a non-transitory computer-readable storage device or storage disk such as a memory, a digital versatile disk (DVD), a compact disc (CD), a Blu-ray disk, etc. including the software and/or firmware. Further still, the example windowed sliding transformer 100 may include one or more elements, processes and/or devices in addition to, or instead of, those illustrated in FIG. 1, and/or may include more than one of any or all of the illustrated elements, processes and devices. As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

Figure 4:
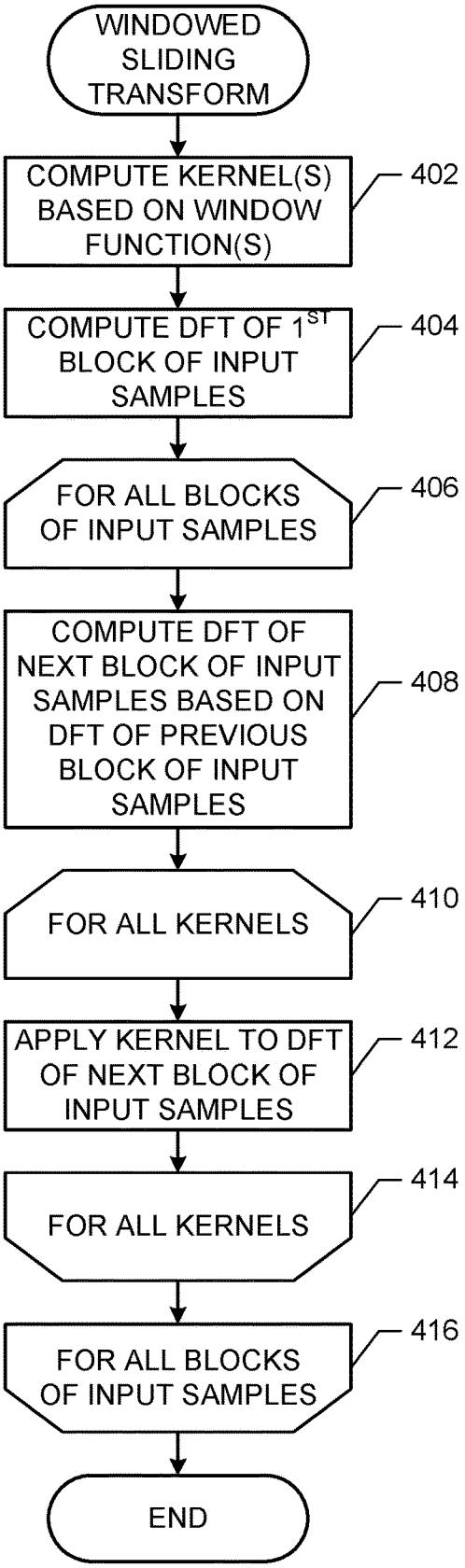
FIG. 4 is a flowchart representative of example hardware logic and/or machine-readable instructions for implementing the example windowed sliding transformer of FIG. 1.

A flowchart representative of example hardware logic or machine-readable instructions for implementing the windowed sliding transformer 100 is shown in FIG. 4. The machine-readable instructions may be a program or portion of a program for execution by a processor such as the processor 1410 shown in the example processor platform 1400 discussed below in connection with FIG. 14. The program may be embodied in software stored on a non-transitory computer-readable storage medium such as a compact disc read-only memory (CD-ROM), a floppy disk, a hard drive, a DVD, a Blu-ray disk, or a memory associated with the processor 1410, but the entire program and/or parts thereof could alternatively be executed by a device other than the processor 1410 and/or embodied in firmware or dedicated hardware. Further, although the example program is described with reference to the flowchart illustrated in FIG. 4, many other methods of implementing the example windowed sliding transformer 100 may alternatively be used. For example, the order of execution of the blocks may be changed, and/or some of the blocks described may be changed, eliminated, or combined. Additionally, and/or alternatively, any or all of the blocks may be implemented by one or more hardware circuits (e.g., discrete and/or integrated analog and/or digital circuitry, a field programmable gate array (FPGA), an ASIC, a comparator, an operational-amplifier (op-amp), a logic circuit, etc.) structured to perform the corresponding operation without executing software or firmware.

As mentioned above, the example processes of FIG. 4 may be implemented using executable instructions (e.g., computer and/or machine-readable instructions) stored on a non-transitory computer and/or machine-readable medium such as a hard disk drive, a flash memory, a read-only memory, a CD-ROM, a DVD, a cache, a random-access memory and/or any other storage device or storage disk in which information is stored for any duration (e.g., for extended time periods, permanently, for brief instances, for temporarily buffering, and/or for caching of the information). As used herein, the term non-transitory computer-readable medium is expressly defined to include any type of computer-readable storage device and/or storage disk and to exclude propagating signals and to exclude transmission media.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, and (6) B with C.

The program of FIG. 4 begins at block 402 where the example kernel generator 122 computes a kernel $K_{k,k'}$ 112 for each window function w 120 being used, considered, etc. by implementing, for example, the example mathematical expression of EQN (5). For example, implementing teaching of this disclosure in connection with teachings of the disclosure of U.S. patent application Ser. No. 15/793,543, filed on Oct. 25, 2017, a DFT transform can be efficiently computed for multiple window functions w 120 to identify the window function w 120 that matches that used to encode the input signal 106. As demonstrated in EQN (4), multiple window functions w 120 can be considered without needing to recompute a DFT.

The transformer 102 computes a DFT 108 of a first block 104 of samples of an input signal 106 (block 404). In some examples, the DFT 108 of the first block 104 is a conventional DFT. For all blocks 104 of the input signal 106 (block 406), the transformer 102 computes a DFT 108 of each block 104 based on the DFT 108 of a previous block 106 (block 408) by implementing, for example, the example mathematical expression of EQN (4).

For all kernels $K_{k,k'}$ 112 computed at block 402 (block 410), the example windower 114 applies the kernel $K_{k,k'}$ 112 to the current DFT 108 (block 412). For example, the example multiplier 116 implements the multiplication of the kernel $K_{k,k'}$ 112 and the DFT 108 shown in the example mathematical expression of EQN (3).

When all kernels $K_{k,k'}$ 112 and blocks 104 have been processed (blocks 414 and 416), control exits from the example program of FIG. 4.

In U.S. patent application Ser. No. 15/793,543 it was disclosed that it was advantageously discovered that, in some instances, different sources of streaming media (e.g., NETFLIX®, HULU®, YOUTUBE®, AMAZON PRIME®, APPLE TV®, etc.) use different audio compression configurations to store and stream the media they host. In some examples, an audio compression configuration is a set of one or more parameters that define, among possibly other things, an audio coding format (e.g., MP1, MP2, MP3, AAC, AC-3, Vorbis, WMA, DTS, etc.), compression parameters, framing parameters, etc. Because different sources use different audio compression, the sources can be distinguished (e.g., identified, detected, determined, etc.) based on the audio compression applied to the media. The media is de-compressed during playback. In some examples, the de-compressed audio signal is compressed using different trial audio compression configurations for compression artifacts. Because compression artifacts become detectable (e.g., perceptible, identifiable, distinct, etc.) when a particular audio compression configuration matches the compression used during the original encoding, the presence of compression artifacts can be used to identify one of the trial audio compression configurations as the audio compression configuration used originally. After the compression configuration is identified, the AME can infer the original source of the audio. Example compression artifacts are discontinuities between points in a spectrogram, a plurality of points in a spectrogram that are small (e.g., below a threshold, relative to other points in the spectrogram), one or more values in a spectrogram having probabilities of occurrence that are disproportionate compared to other values (e.g., a large number of small values), etc. In instances where two or more sources use the same audio compression configuration and are associated with compression artifacts, the audio compression configuration may be used to reduce the number of sources to consider. Other methods may then be used to distinguish between the sources. However, for simplicity of explanation the examples disclosed herein assume that sources are associated with different audio compression configurations.

Disclosed examples identify the source(s) of media by identifying the audio compression applied to the media (e.g., to an audio portion of the media). In some examples, audio compression identification includes the identification of the compression that an audio signal has undergone, regardless of the content. Compression identification can include, for example, identification of the bit rate at which the audio data was encoded, the parameters used at the time-frequency decomposition stage, the samples in the audio signal where the framing took place before the windowing and transform were applied, etc. As disclosed herein, the audio compression can be identified from media that has been de-compressed and output using an audio device such as a speaker, and recorded. The recorded audio, which has undergone lossy compression and de-compression, can be re-compressed according to different trial audio compressions. In some examples, the trial re-compression that results in the largest compression artifacts is identified as the audio compression that was used to originally compress the media. The identified audio compression is used to identify the source of the media. While the examples disclosed herein only partially re-compress the audio (e.g., perform only the time-frequency analysis stage of compression), full re-compression may be performed. Reference will now be made in detail to non-limiting examples of this disclosure, examples of which are illustrated in the accompanying drawings. The examples are described below by referring to the drawings.

Figure 5:
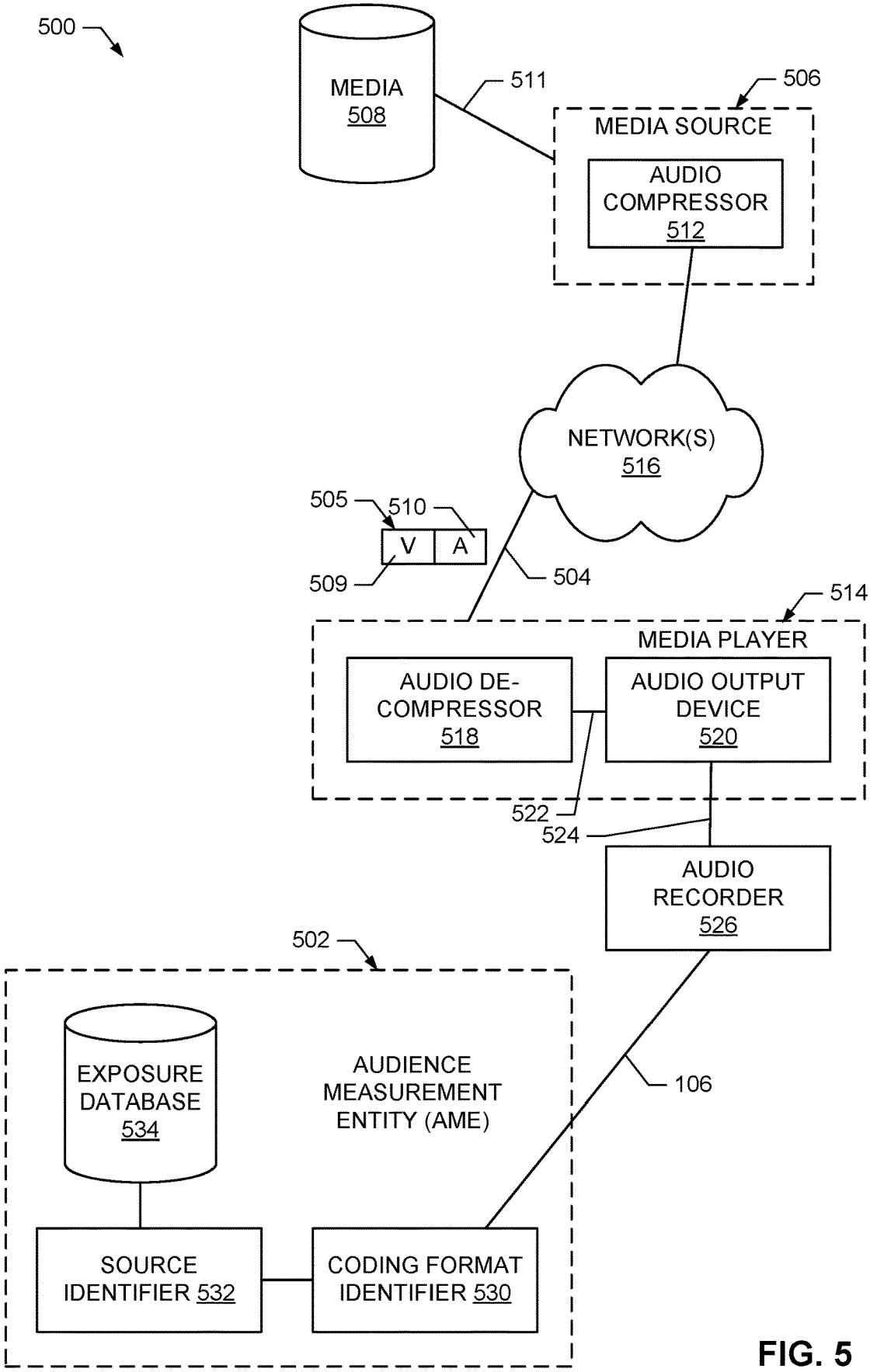
FIG. 5 illustrates an example environment in which an example audience measurement entity (AME), in accordance with this disclosure, identifies sources of network streaming services.

FIG. 5 illustrates an example environment 500 in which an example AME 502, in accordance with this disclosure, identifies sources of network streaming services. To provide media 504 (e.g., a song, a movie 505 including video 509 and audio 510, a television show, a game, etc.), the example environment 500 includes one or more streaming media sources (e.g., NETFLIX®, HULU®, YOUTUBE®, AMAZON PRIME®, APPLE TV®, etc.), an example of which is designated at reference numeral 506. To form compressed audio signals (e.g., the audio 510 of the video program 505) from an audio signal 511, the example media source 506 includes an example audio compressor 512. In some examples, audio is compressed by the audio compressor 512 (or another compressor implemented elsewhere) and stored in the media data store 508 for subsequent recall and streaming. The audio signals may be compressed by the example audio compressor 512 using any number and/or type(s) of audio compression configurations (e.g., audio coding formats (e.g., MP1, MP2, MP3, AAC, AC-3, Vorbis, WMA, DTS, etc.), compression parameters, framing parameters, etc.) Media may be stored in the example media data store 508 using any number and/or type(s) of data structure(s). The media data store 508 may be implemented using any number and/or type(s) of non-volatile, and/or volatile computer-readable storage device(s) and/or storage disk(s).

To present (e.g., playback, output, display, etc.) media, the example environment 500 of FIG. 5 includes any number and/or type(s) of example media presentation device, one of which is designated at reference numeral 514. Example media presentation devices 514 include, but are not limited to a gaming console, a personal computer, a laptop computer, a tablet, a smart phone, a television, a set-top box, or, more generally, any device capable of presenting media. The example media source 506 provides the media 504 (e.g., the movie 505 including the compressed audio 510) to the example media presentation device 514 using any number and/or type(s) of example public, and/or public network(s) 516 or, more generally, any number and/or type(s) of communicative couplings.

To present (e.g., playback, output, etc.) audio (e.g., a song, an audio portion of a video, etc.), the example media presentation device 514 includes an example audio de-compressor 518, and an example audio output device 520. The example audio de-compressor 518 de-compresses the audio 510 to form de-compressed audio 522. In some examples, the audio compressor 512 specifies to the audio de-compressor 518 in the compressed audio 510 the audio compression configuration used by the audio compressor 512 to compress the audio. The de-compressed audio 522 is output by the example audio output device 520 as an audible signal 524. Example audio output devices 520 include, but are not limited, a speaker, an audio amplifier, headphones, etc. While not shown, the example media presentation device 514 may include additional output devices, ports, etc. that can present signals such as video signals. For example, a television includes a display panel, a set-top box includes video output ports, etc.

To record the audible audio signal 524, the example environment 500 of FIG. 5 includes an example recorder 526. The example recorder 526 of FIG. 5 is any type of device capable of capturing, storing, and conveying the audible audio signal 524. In some examples, the recorder 526 is implemented by a people meter owned and operated by The Nielsen Company, the Applicant of the instant application. In some examples, the media presentation device 514 is a device (e.g., a personal computer, a laptop, etc.) that can output the audio 524 and record the audio 524 with a connected or integral microphone. In some examples, the de-compressed audio 522 is recorded without being output. Audio signals 106 (e.g., input signal 106) recorded by the example audio recorder 526 are conveyed to the example AME 502 for analysis.

To identify the media source 506 associated with the audible audio signal 524, the example AME 502 includes an example coding format identifier 530 and an example source identifier 532. The example coding format identifier 530 identifies the audio compression applied by the audio compressor 512 to form the compressed audio signal 510. The coding format identifier 530 identifies the audio compression from the de-compressed audio signal 524 output by the audio output device 520, and recorded by the audio recorder 526. The recorded audio 106, which has undergone lossy compression at the audio compressor 512, and de-compression at the audio de-compressor 518 is re-compressed by the coding format identifier 530 according to different trial audio compression types and/or settings. In some examples, the trial re-compression that results in the largest compression artifacts is identified by the coding format identifier 530 as the audio compression that was used at the audio compressor 512 to originally compress the media.

The example source identifier 530 of FIG. 5 uses the identified audio compression to identify the source 506 of the media 504. In some examples, the source identifier 530 uses a lookup table to identify, or narrow the search space for identifying the media source 506 associated with an audio compression identified by the coding format identifier 530. An association of the media 504 and the media source 506, among other data (e.g., time, day, viewer, location, etc.) is recorded in an example exposure database 534 for subsequent development of audience measurement statistics.

Figure 6:
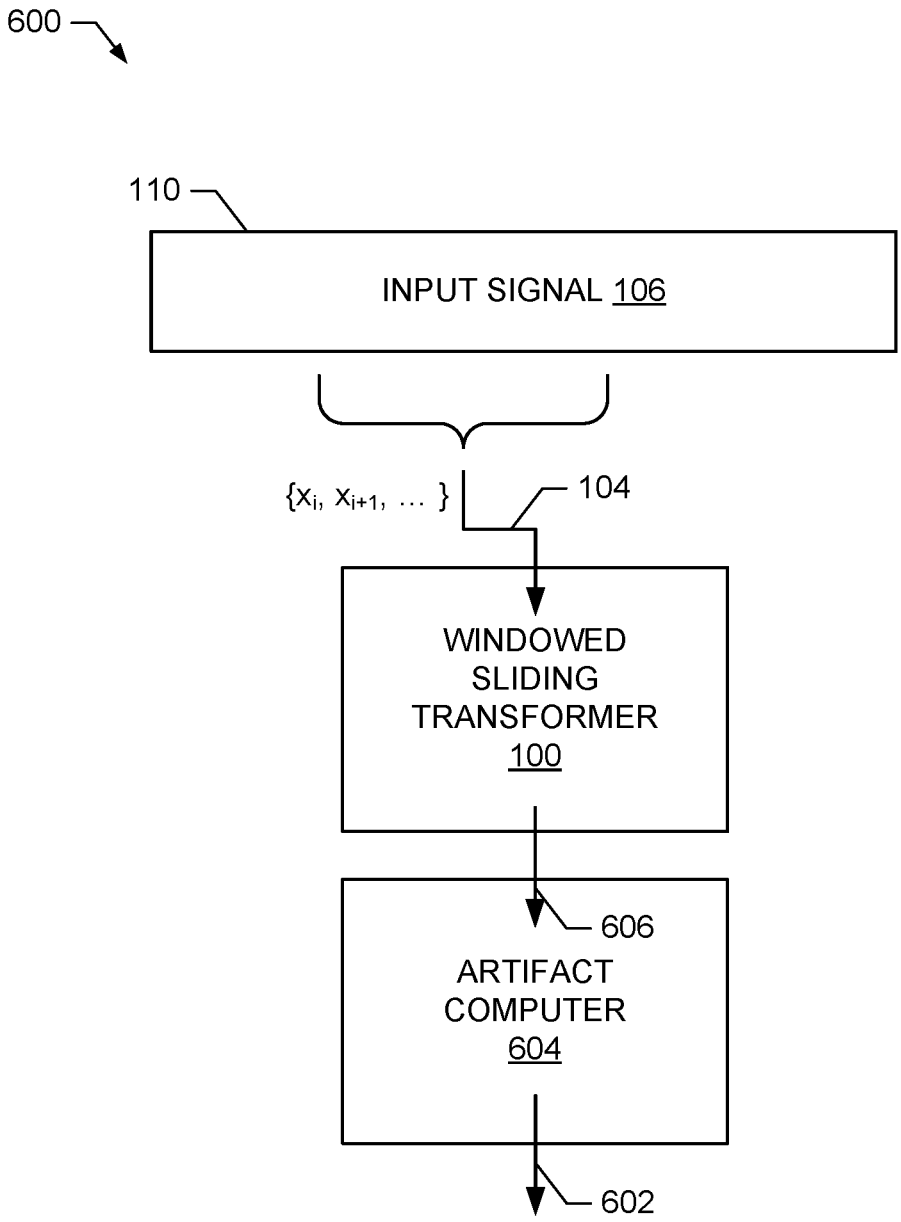
FIG. 6 illustrates an example system for computing compression artifacts using the example windowed sliding transformer of FIG. 1.

FIG. 6 illustrates an example system 600 for computing compression artifacts 602 using the example windowed sliding transformer 100 of FIG. 1. To compute compression artifacts, the example system 600 of FIG. 6 includes an example artifact computer 604. The example artifact computer 604 of FIG. 6 detects small values (e.g., values that have been quantized to zero) in frequency-domain representations 606 computed by the windowed sliding transformer 100. Small values in the frequency-domain representations 606 represent compression artifacts, and are used, in some examples, to determine when a trial audio compression corresponds to the audio compression applied by an audio compressor. Example implementations of the example artifact computer 604, and example processing of the artifacts 602 to identify codec format and/or source are disclosed in U.S. patent application Ser. No. 15/793,543.

In U.S. patent application Ser. No. 15/793,543, for each starting location, a time-frequency analyzer applies a time-domain window function, and then computes a full time-to-frequency transform. Such solutions may be computationally infeasible, complex, costly, etc. In stark contrast, applying teachings of this disclosure to implement the example time-frequency analyzer U.S. patent application Ser. No. 15/793,543 with the windowed sliding transform 100, as shown in FIGS. 1 and 6, sliding transforms and low-complexity kernels can be used to readily compute compression artifacts for large combinations of codecs, window locations, codec parameter sets, etc. with low complexity and cost, making the teachings of U.S. patent application Ser. No. 15/793,543 feasible on lower complexity devices.

For example, computation of the sliding DFT of EQN (1) requires 2N additions and N multiplications (where N is the number of samples being processed). Therefore, the sliding DFT has a linear complexity of the order of N. By applying a time-domain window as the kernel $K_{k,k'}$ 112 after a sliding DFT as shown in EQN (4), the computational efficiency of the windowed sliding DFT is maintained. The complexity of the kernel $K_{k,k'}$ 112 is KN additions and SN multiplications, where S is the number of non-zero values in the kernel $K_{k,k'}$ 112. When S<<N (e.g., 3 or 5), the windowed sliding DFT remains of linear complexity of the order of N. In stark contrast, the conventional methods of computing a DFT and an FFT are of the order of $N^2$ and N log(N), respectively. Applying a conventional time-domain window function (i.e., applying the window on the signal before computing a DFT) will be at best of the order of N log(N) (plus some extra additions and multiplications) as the DFT needs to be computed for each sample. By way of comparison, complexity of the order of N is considered to be low complexity, complexity of the order of N log(N) is considered to be moderate complexity, and complexity of the order of $N^2$ is considered to be high complexity.

Figure 7:
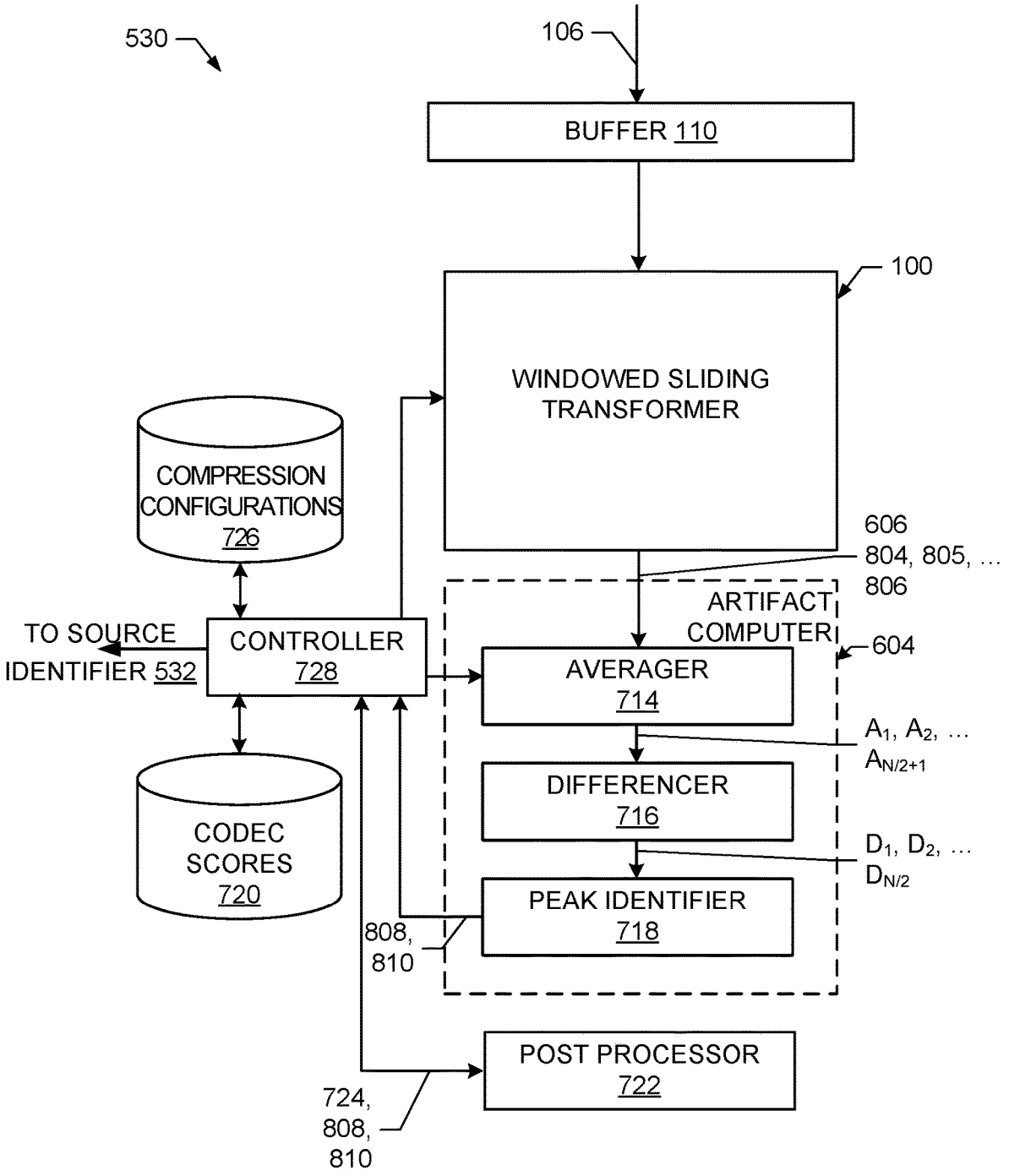
FIG. 7 is a block diagram illustrating an example implementation of the example coding format identifier of FIG. 5 and an example implementation of FIG. 6.
Figure 8:
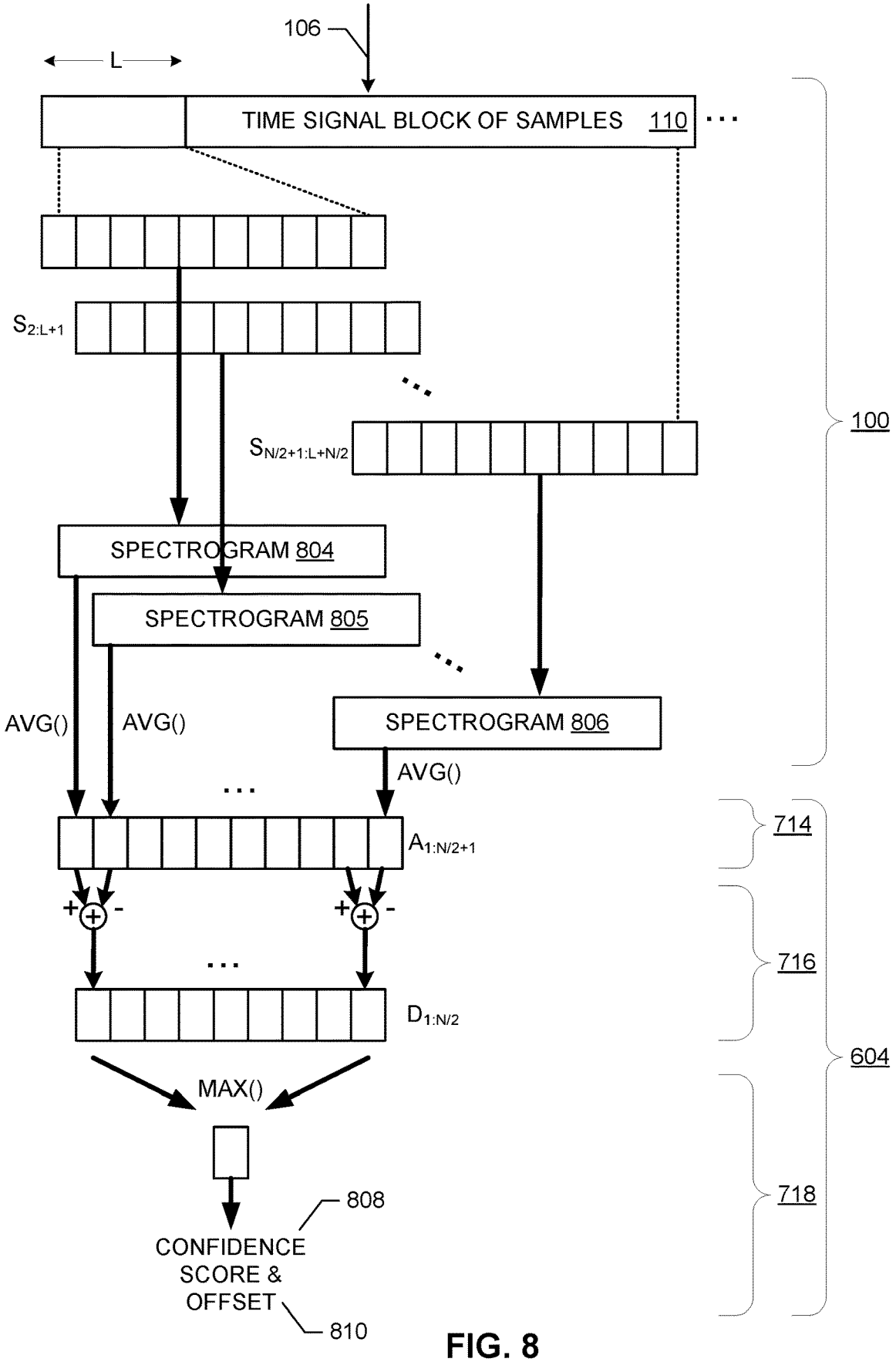
FIG. 8 is a diagram illustrating an example operation of the example coding format identifier of FIG. 7.

FIG. 7 is a block diagram illustrating an example implementation of the example coding format identifier 530 of FIG. 5. FIG. 8 is a diagram illustrating an example operation of the example coding format identifier 530 of FIG. 7. For ease of understanding, it is suggested that the interested reader refer to FIG. 8 together with FIG. 7. Wherever possible, the same reference numbers are used in FIGS. 7 and 8, and the accompanying written description to refer to the same or like parts.

To store (e.g., buffer, hold, etc.) incoming samples of the recorded audio 106, the example coding format identifier 530 includes an example buffer 110 of FIG. 1. The example buffer 110 may be implemented using any number and/or type(s) of non-volatile, and/or volatile computer-readable storage device(s) and/or storage disk(s).

To perform time-frequency analysis, the example coding format identifier 530 includes the example windowed sliding transformer 100. The example windowed sliding transformer 100 of FIGS. 1 and/or 7 windows the recorded audio 106 into windows (e.g., segments of the buffer 110 defined by a sliding or moving window), and estimates the spectral content of the recorded audio 106 in each window.

To compute compression artifacts, the example coding format identifier 530 of FIG. 7 includes an example artifact computer 604. The example artifact computer 604 of FIG. 7 detects small values (e.g., values that have been quantized to zero) in data 606 (e.g., the spectrograms 804-806). Small values in the spectrograms 804-806 represent compression artifacts, and are used, in some examples, to determine when a trial audio compression corresponds to the audio compression applied by the audio compressor 512 (FIG. 5).

To compute an average of the values of a spectrogram 804-806, the artifact computer 604 of FIG. 7 includes an example averager 714. The example averager 714 of FIG. 7 computes an average $A_1, A_2, \ldots A_{N/2+1}$ of the values of corresponding spectrograms 804-806 for the plurality of windows $S_{1:L}, S_{2:L+1}, \ldots S_{N/2+1:L+N/2}$ of the block of samples 110. The averager 714 can compute various means, such as, an arithmetic mean, a geometric mean, etc. Assuming the audio content stays approximately the same between two adjacent spectrograms 804, 805, . . . 806, the averages $A_1, A_2, A_{N/2+1}$ will also be similar. However, when audio compression configuration and framing match those used at the audio compressor 512, small values will appear in a particular spectrogram 804-806, and differences $D_1, D_2, D_{N/2}$ between the averages $A_1, A_2, A_{N/2+1}$ will occur. The presence of these small values in a spectrogram 804-806 and/or differences $D_1, D_2, \ldots D_{N/2}$ between averages $A_1, A_2, A_{N/2+1}$ can be used, in some examples, to identify when a trial audio compression configuration results in compression artifacts.

To detect the small values, the example artifact computer 604 includes an example differencer 716. The example differencer 716 of FIG. 7 computes the differences $D_1, D_2, \ldots D_{N/2}$ (see FIG. 8) between averages $A_1, A_2, A_{N/2+1}$ of the spectrograms 804-806 computed using different window locations 1, 2, . . . N/2+1. When a spectrogram 804-806 has small values representing potential compression artifacts, it will have a smaller spectrogram average $A_1, A_2, A_{N/2+1}$ than the spectrograms 804-806 for other window locations. Thus, its differences $D_1, D_2, \ldots D_{N/2}$ from the spectrograms 804-806 for the other window locations will be larger than differences $D_1, D_2, \ldots D_{N/2}$ between other pairs of spectrograms 804-806. In some examples, the differencer 716 computes absolute (e.g., positive valued) differences.

To identify the largest difference $D_1, D_2, D_{N/2}$ between the averages $A_1, A_2, \ldots A_{N/2+1}$ of spectrograms 804-806, the example artifact computer 604 of FIG. 7 includes an example peak identifier 718. The example peak identifier 718 of FIG. 7 identifies the largest difference $D_1, D_2, \ldots D_{N/2}$ for a plurality of window locations 1, 2, . . . N/2+1. The largest difference $D_1, D_2, \ldots D_{N/2}$ corresponding to the window location 1, 2, . . . N/2+1 used by the audio compressor 512. As shown in the example of FIG. 8, the peak identifier 718 identifies the difference $D_1, D_2, \ldots D_{N/2}$ having the largest value. As will be explained below, in some examples, the largest value is considered a confidence score 808 (e.g., the greater its value the greater the confidence that a compression artifact was found), and is associated with an offset 810 (e.g., 1, 2, . . . , N/2+1) that represents the location of the window $S_{1:L}, S_{2:L+1}, \ldots S_{N/2+1:L+N/2}$ associated with the average $A_1, A_2, \ldots A_{N/2+1}$. The example peak identifier 718 stores the confidence score 808 and the offset 810 in a coding format scores data store 720. The confidence score 808 and the offset 810 may be stored in the example coding format scores data store 720 using any number and/or type(s) of data structure(s). The coding format scores data store 720 may be implemented using any number and/or type(s) of non-volatile, and/or volatile computer-readable storage device(s) and/or storage disk(s).

Figure 9:
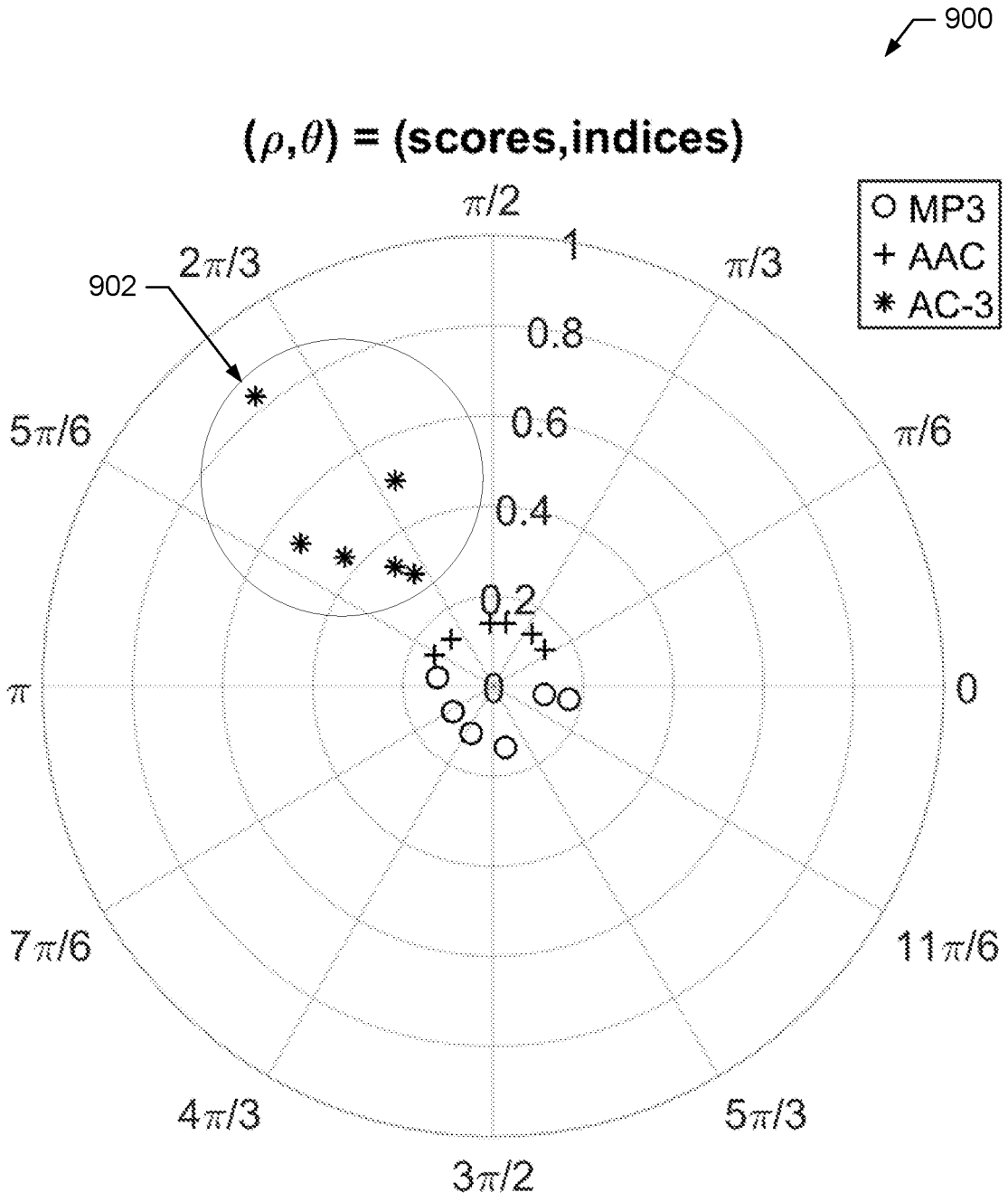
FIG. 9 is an example polar graph of example scores and offsets.

A peak in the differences $D_1, D_2, \ldots D_{N/2}$ nominally occurs every T samples in the signal. In some examples, T is the hop size of the time-frequency analysis stage of a coding format, which is typically half of the window length L. In some examples, confidence scores 808 and offsets 810 from multiple blocks of samples of a longer audio recording are combined to increase the accuracy of coding format identification. In some examples, blocks with scores under a chosen threshold are ignored. In some examples, the threshold can be a statistic computed from the differences, for example, the maximum divided by the mean. In some examples, the differences can also be first normalized, for example, by using the standard score. To combine confidence scores 808 and offsets 810, the example coding format identifier 530 includes an example post processor 722. The example post processor 722 of FIG. 7 translates pairs of confidence scores 808 and offsets 810 into polar coordinates. In some examples, a confidence score 808 is translated into a radius (e.g., expressed in decibels), and an offset 810 is mapped to an angle (e.g., expressed in radians modulo its periodicity). In some examples, the example post processor 722 computes a circular mean of these polar coordinate points (i.e., a mean computed over a circular region about an origin), and obtains an average polar coordinate point whose radius corresponds to an overall confidence score 724. In some examples, a circular sum can be computed, by multiplying the circular mean by the number of blocks whose scores was above the chosen threshold. The closer the pairs of points are to each other in the circle, and the further they are from the center, the larger the overall confidence score 724. In some examples, the post processor 722 computes a circular sum by multiplying the circular mean and the number of blocks whose scores were above the chosen threshold. The example post processor 722 stores the overall confidence score 724 in the coding format scores data store 720 using any number and/or type(s) of data structure(s). An example polar plot 900 of example pairs of scores and offsets is shown in FIG. 9, for five different audio compression configurations: MP3, AAC, AC-3, Vorbis and WMA. As shown in FIG. 9, the AC-3 coding format has a plurality of points (e.g., see the example points in the example region 902) having similar angles (e.g., similar window offsets), and larger scores (e.g., greater radiuses) than the other coding formats. If a circular mean is computed for each configuration, the means for MP3, AAC, Vorbis and WMA would be near the origin, while the mean for AC-3 would be distinct from the origin, indicating that the audio 106 was originally compressed with the AC-3 coding format.

To store sets of audio compression configurations, the example coding format identifier 530 of FIG. 7 includes an example compression configurations data store 726. To control coding format identification, the example coding format identifier 530 of FIG. 7 includes an example controller 728. To identify the audio compression applied to the audio 106, the example controller 728 configures the windowed sliding transformer 100 with different compression configurations. For combinations of a trial compression configuration (e.g., AC-3) and each of a plurality of window offsets, the windowed sliding transformer 100 computes a spectrogram 804-806. The example artifact computer 604 and the example post processor 722 determine the overall confidence score 724 for each the trial compression configuration. The example controller 728 identifies (e.g., selects) the one of the trial compression configurations having the largest overall confidence score 724 as the compression configuration that had been applied to the audio 106.

The compression configurations may be stored in the example compression configurations data store 726 using any number and/or type(s) of data structure(s). The compression configurations data store 726 may be implemented using any number and/or type(s) of non-volatile, and/or volatile computer-readable storage device(s) and/or storage disk(s). The example controller 728 of FIG. 7 may be implemented using, for example, one or more of each of a circuit, a logic circuit, a programmable processor, a programmable controller, a graphics processing unit (GPU), a digital signal processor (DSP), an application specific integrated circuit (ASIC), a programmable logic device (PLD), a field programmable gate array (FPGA), and/or a field programmable logic device (FPLD).

While an example implementation of the coding format identifier 530 is shown in FIG. 7, other implementations, such as machine learning, etc. may additionally, and/or alternatively, be used. While an example manner of implementing the coding format identifier 530 of FIG. 5 is illustrated in FIG. 7, one or more of the elements, processes and/or devices illustrated in FIG. 7 may be combined, divided, re-arranged, omitted, eliminated and/or implemented in any other way. Further, the example windowed sliding transformer 100, the example artifact computer 604, the example averager 714, the example differencer 716, the example peak identifier 718, the example post processor 722, the example controller 728 and/or, more generally, the example coding format identifier 530 of FIG. 7 may be implemented by hardware, software, firmware and/or any combination of hardware, software and/or firmware. Thus, for example, any of the example windowed sliding transformer 100, the example artifact computer 604, the example averager 714, the example differencer 716, the example peak identifier 718, the example post processor 722, the example controller 728 and/or, more generally, the example coding format identifier 530 could be implemented by one or more analog or digital circuit(s), logic circuits, programmable processor(s), programmable controller(s), GPU(s), DSP(s), ASIC(s), PLD(s), FPGA(s), and/or FPLD(s). When reading any of the apparatus or system claims of this patent to cover a purely software and/or firmware implementation, at least one of the example, windowed sliding transformer 100, the example artifact computer 604, the example averager 714, the example differencer 716, the example peak identifier 718, the example post processor 722, the example controller 728, and/or the example coding format identifier 530 is/are hereby expressly defined to include a non-transitory computer-readable storage device or storage disk such as a memory, a digital versatile disk (DVD), a compact disk (CD), a Blu-ray disk, etc. including the software and/or firmware. Further still, the example coding format identifier 530 of FIG. 5 may include one or more elements, processes and/or devices in addition to, or instead of, those illustrated in FIG. 7, and/or may include more than one of any or all the illustrated elements, processes and devices.

Figure 10:
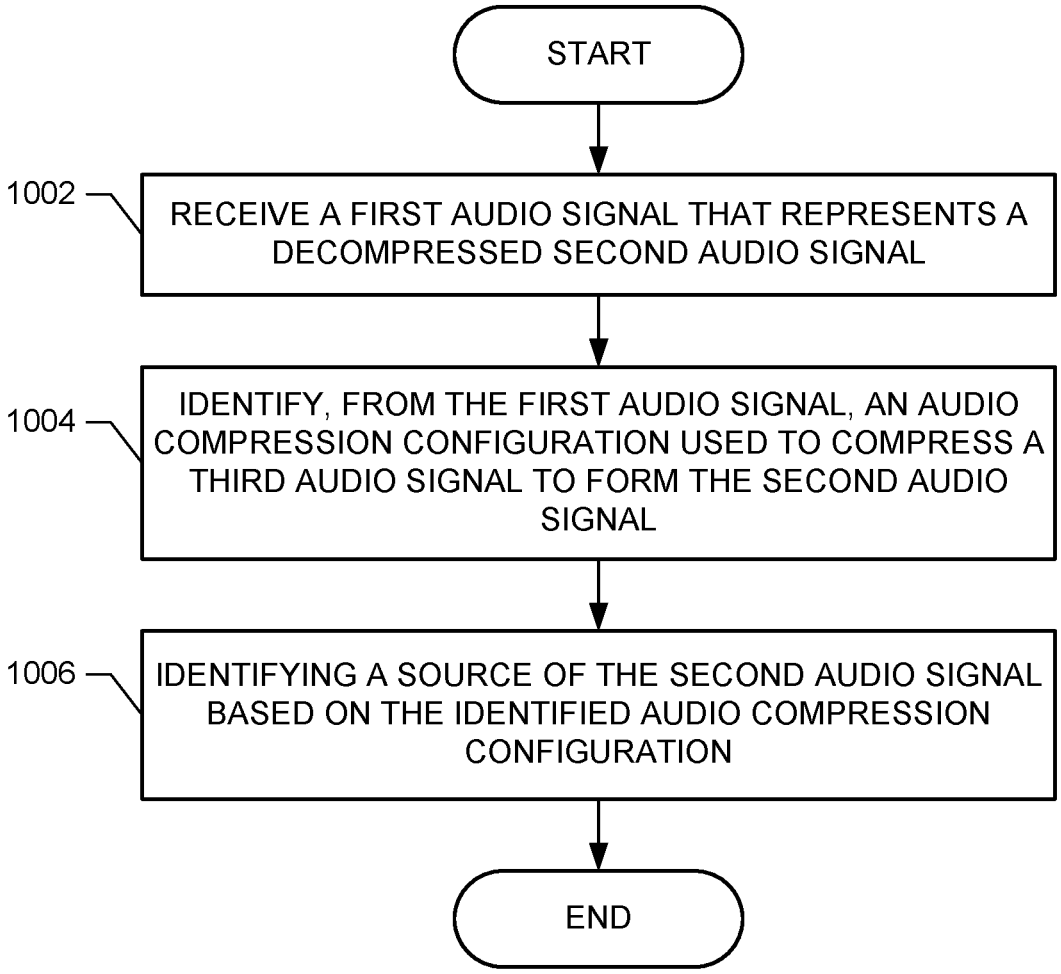
FIG. 10 is a flowchart representing example processes that may be implemented as machine-readable instructions that may be executed to implement the example AME to identify sources of network streaming services.

A flowchart representative of example machine-readable instructions for implementing the example AME 502 of FIG. 5 is shown in FIG. 10. In this example, the machine-readable instructions comprise a program for execution by a processor such as the processor 1310 shown in the example processor platform 1300 discussed below in connection with FIG. 13. The program may be embodied in software stored on a non-transitory computer-readable storage medium such as a CD, a floppy disk, a hard drive, a DVD, a Blu-ray disk, or a memory associated with the processor 1310, but the entire program and/or parts thereof could alternatively be executed by a device other than the processor 1310 and/or embodied in firmware or dedicated hardware. Further, although the example program is described with reference to the flowchart illustrated in FIG. 10, many other methods of implementing the example AME 502 may alternatively be used. For example, the order of execution of the blocks may be changed, and/or some of the blocks described may be changed, eliminated, or combined. Additionally, and/or alternatively, any or all the blocks may be implemented by one or more hardware circuits (e.g., discrete and/or integrated analog and/or digital circuitry, FPGA(s), ASIC(s), comparator(s), operational-amplifier(s) (op-amp(s)), logic circuit(s), etc.) structured to perform the corresponding operation without executing software or firmware.

The example program of FIG. 10 begins at block 1002, where the AME 502 receives a first audio signal (e.g., the example audio signal 106) that represents a decompressed a second audio signal (e.g., the example audio signal 510) (block 1002). The example coding format identifier 530 identifies, from the first audio signal, an audio compression configuration used to compress a third audio signal (e.g., the example audio signal 511) to form the second audio signal (block 1004). The example source identifier 532 identifies a source of the second audio signal based on the identified audio compression configuration (block 1006). Control exits from the example program of FIG. 10.

Figure 11:
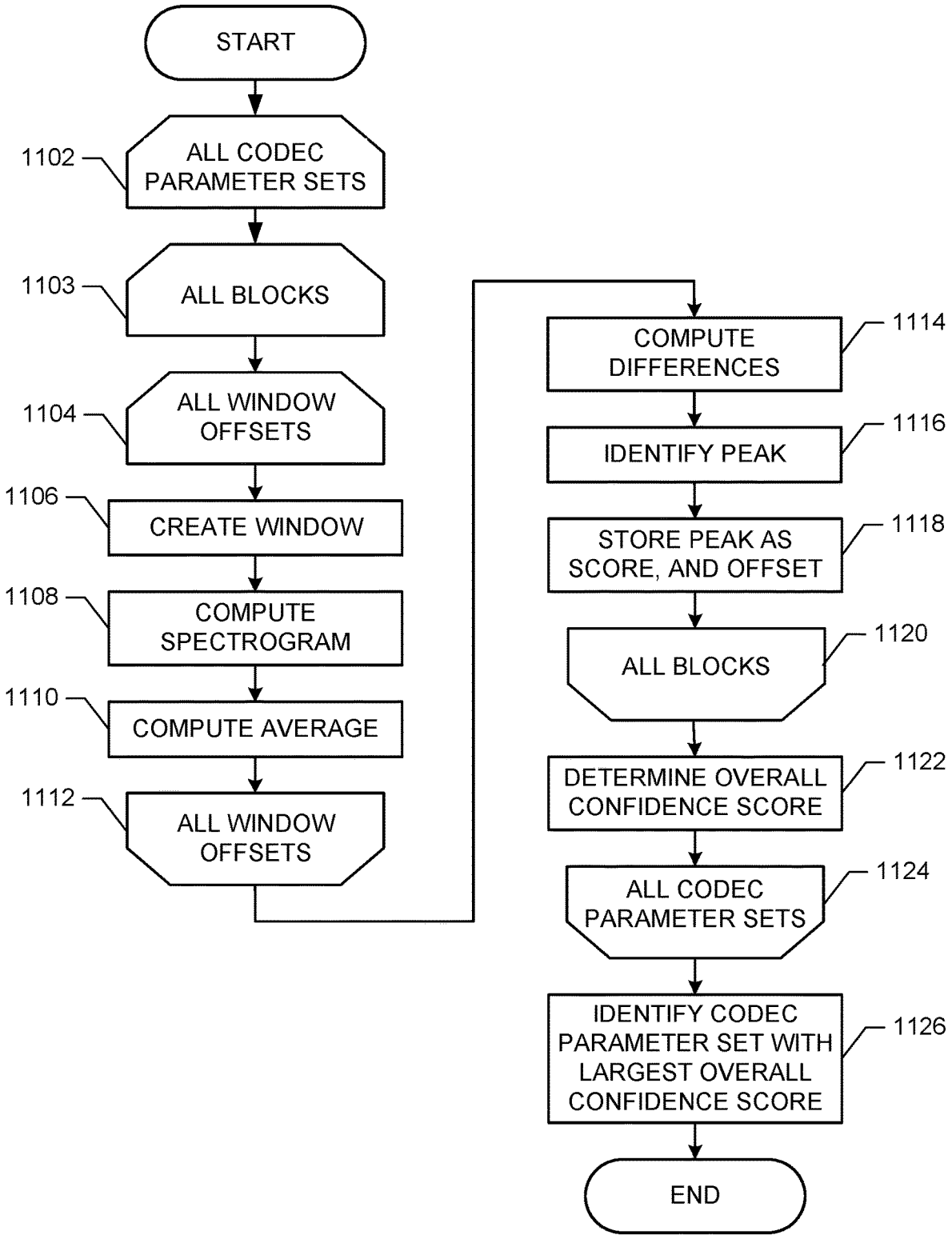
FIG. 11 is a flowchart representing another example processes that may be implemented as machine-readable instructions that may be executed to implement the example coding format identifier of FIGS. 7 and/or 8 to identify sources of network streaming services.

A flowchart representative of example machine-readable instructions for implementing the example coding format identifier 530 of FIGS. 5 and/or 7 is shown in FIG. 11. In this example, the machine-readable instructions comprise a program for execution by a processor such as the processor 1310 shown in the example processor platform 1300 discussed below in connection with FIG. 13. The program may be embodied in software stored on a non-transitory computer-readable storage medium such as a CD, a floppy disk, a hard drive, a DVD, a Blu-ray disk, or a memory associated with the processor 1310, but the entire program and/or parts thereof could alternatively be executed by a device other than the processor 1310 and/or embodied in firmware or dedicated hardware. Further, although the example program is described with reference to the flowchart illustrated in FIG. 11, many other methods of implementing the example coding format identifier 130 may alternatively be used. For example, the order of execution of the blocks may be changed, and/or some of the blocks described may be changed, eliminated, or combined. Additionally, and/or alternatively, any or all the blocks may be implemented by one or more hardware circuits (e.g., discrete and/or integrated analog and/or digital circuitry, FPGA(s), ASIC(s), comparator(s), operational-amplifier(s) (op-amp(s)), logic circuit(s), etc.) structured to perform the corresponding operation without executing software or firmware.

The example program of FIG. 11 begins at block 1102, where for each set of trial compression configuration, each block 110 of samples (block 1103), and each window offset M (block 1104), the example windower 114 creates a window SM:L+M (block 1106), and the example transformer 102 computes a spectrogram 804-806 of the window SM:L+M (block 1108). The averager 714 computes an average $A_M$ of the spectrogram 804-806 (block 1110). When the average $A_M$ of a spectrogram 804-806 has been computed for each window offset M (block 1112), the example differencer 716 computes differences $D_1$, $D_2$, . . . $D_{N/2}$ between the pairs of the averages $A_M$ (block 1114). The example peak identifier 718 identifies the largest difference (block 1116), and stores the largest difference as the score 808 and the associated offset M as the offset 810 in the coding format scores data store 720 (block 1118).

When all blocks have been processed (block 1120), the example post processor 722 translates the score 808 and offset 810 pairs for the currently considered trial coding format parameter set into polar coordinates, and computes a circular mean of the pairs in polar coordinates as an overall confidence score for the currently considered compression configuration (block 1122).

When all trial compression configurations have been processed (block 1124), the controller 728 identifies the trial compression configuration set with the largest overall confidence score as the audio compression applied by the audio compressor 512 (block 1126). Control then exits from the example program of FIG. 11.

As mentioned above, the example processes of FIGS. 10 and 11 may be implemented using coded instructions (e.g., computer and/or machine-readable instructions) stored on a non-transitory computer and/or machine-readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer-readable medium is expressly defined to include any type of computer-readable storage device and/or storage disk and to exclude propagating signals and to exclude transmission media.

Figure 12:
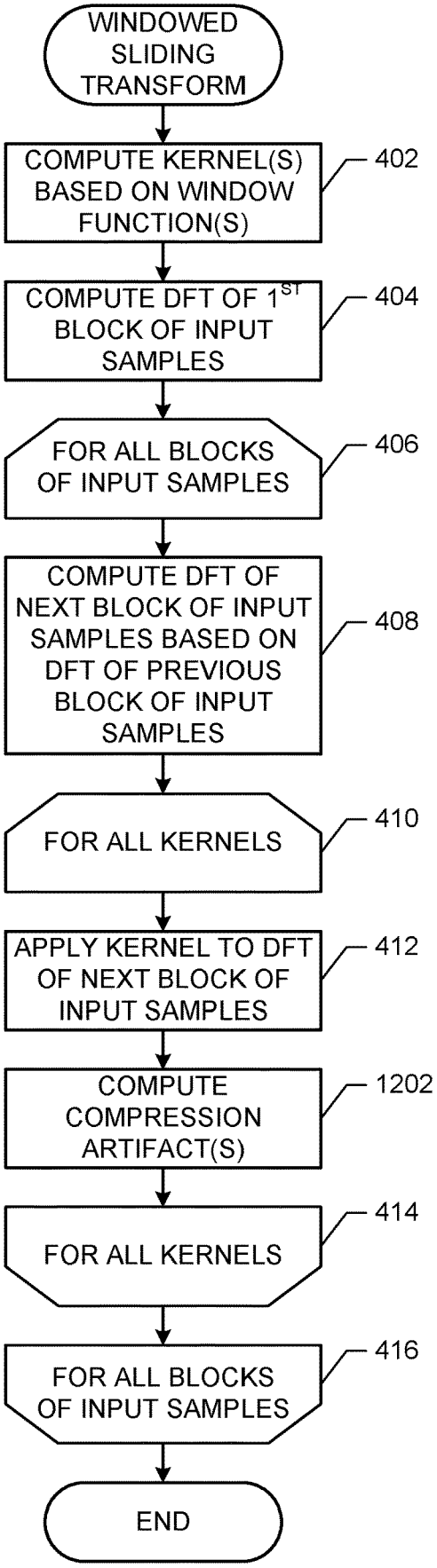
FIG. 12 is a flowchart representative of example hardware logic and/or machine-readable instructions for computing a plurality of compression artifacts for combinations of parameters using the windowed sliding transformer 100 of FIG. 1.

A flowchart representative of example hardware logic or machine-readable instructions for computing a plurality of compression artifacts for combinations of parameters using the windowed sliding transformer 100 is shown in FIG. 12. The machine-readable instructions may be a program or portion of a program for execution by a processor such as the processor 1410 shown in the example processor platform 1400 discussed below in connection with FIG. 14. The program may be embodied in software stored on a non-transitory computer-readable storage medium such as a compact disc read-only memory (CD-ROM), a floppy disk, a hard drive, a DVD, a Blu-ray disk, or a memory associated with the processor 1410, but the entire program and/or parts thereof could alternatively be executed by a device other than the processor 1410 and/or embodied in firmware or dedicated hardware. Further, although the example program is described with reference to the flowchart illustrated in FIG. 12, many other methods of implementing the example windowed sliding transformer 100 may alternatively be used. For example, the order of execution of the blocks may be changed, and/or some of the blocks described may be changed, eliminated, or combined. Additionally, and/or alternatively, any or all of the blocks may be implemented by one or more hardware circuits (e.g., discrete and/or integrated analog and/or digital circuitry, a field programmable gate array (FPGA), an ASIC, a comparator, an operational-amplifier (op-amp), a logic circuit, etc.) structured to perform the corresponding operation without executing software or firmware.

In comparison to FIG. 4, in the example program of FIG. 12 the example artifact computer 604 computes one or more compression artifacts 602 at block 1202 after the windower 114 applies the kernel $K_{k,k'}$ 112 at block 412. Through use of the windowed sliding transformer 100 as shown in FIG. 6, compression artifacts 602 can be computed for large combinations of codecs, window locations, codec parameter sets, etc. with low complexity and cost.

Figure 13:
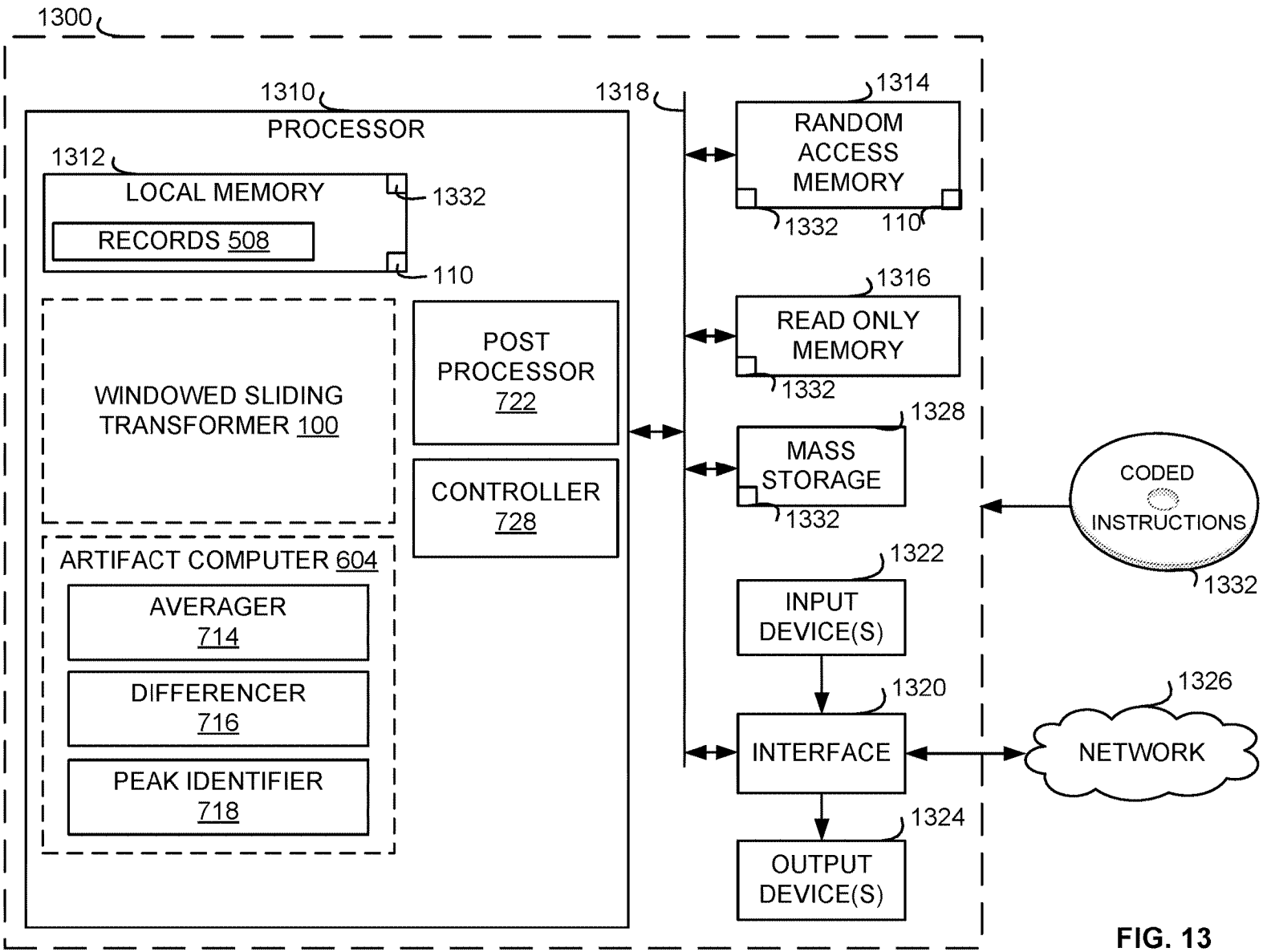
FIG. 13 illustrates an example processor platform structured to execute the example machine-readable instructions of FIG. 10 to implement the example coding format identifier of FIGS. 7 and/or 8.

FIG. 13 is a block diagram of an example processor platform 1300 capable of executing the instructions of FIG. 11 to implement the coding format identifier 530 of FIGS. 5 and/or 7. The processor platform 1300 can be, for example, a server, a personal computer, a workstation, or any other type of computing device.

The processor platform 1300 of the illustrated example includes a processor 1310. The processor 1310 of the illustrated example is hardware. For example, the processor 1310 can be implemented by one or more integrated circuits, logic circuits, microprocessors, GPUs, DSPs or controllers from any desired family or manufacturer. The hardware processor may be a semiconductor based (e.g., silicon based) device. In this example, the processor implements the example windowed sliding transformer 100, the example artifact computer 712, the example averager 714, the example differencer 716, the example peak identifier 718, the example post processor 722, and the example controller 728.

The processor 1310 of the illustrated example includes a local memory 1312 (e.g., a cache). The processor 1310 of the illustrated example is in communication with a main memory including a volatile memory 1314 and a non-volatile memory 1316 via a bus 1318. The volatile memory 1314 may be implemented by Synchronous Dynamic Random-access Memory (SDRAM), Dynamic Random-access Memory (DRAM), RAMBUS® Dynamic Random-access Memory (RDRAM®) and/or any other type of random-access memory device. The non-volatile memory 1316 may be implemented by flash memory and/or any other desired type of memory device. Access to the main memory 1314, 1316 is controlled by a memory controller (not shown). In this example, the local memory 1312 and/or the memory 1314 implements the buffer 110.

The processor platform 1300 of the illustrated example also includes an interface circuit 1320. The interface circuit 1320 may be implemented by any type of interface standard, such as an Ethernet interface, a universal serial bus (USB) interface, a Bluetooth® interface, a near field communication (NFC) interface, and/or a peripheral component interface (PCI) express interface.

In the illustrated example, one or more input devices 1322 are connected to the interface circuit 1320. The input device(s) 1322 permit(s) a user to enter data and/or commands into the processor 1310. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1324 are also connected to the interface circuit 1320 of the illustrated example. The output devices 1324 can be implemented, for example, by display devices (e.g., a light emitting diode (LED), an organic light emitting diode (OLED), a liquid crystal display (LCD), a cathode ray tube display (CRT), an in-plane switching (IPS) display, a touchscreen, etc.) a tactile output device, a printer, and/or speakers. The interface circuit 1320 of the illustrated example, thus, typically includes a graphics driver card, a graphics driver chip and/or a graphics driver processor.

The interface circuit 1320 of the illustrated example also includes a communication device such as a transmitter, a receiver, a transceiver, a modem, a residential gateway, and/or network interface to facilitate exchange of data with external machines (e.g., computing devices of any kind) via a network 1326 (e.g., an Ethernet connection, a digital subscriber line (DSL), a telephone line, a coaxial cable, a cellular telephone system, a Wi-Fi system, etc.). In some examples of a Wi-Fi system, the interface circuit 1320 includes a radio frequency (RF) module, antenna(s), amplifiers, filters, modulators, etc.

The processor platform 1300 of the illustrated example also includes one or more mass storage devices 1328 for storing software and/or data. Examples of such mass storage devices 1328 include floppy disk drives, hard drive disks, CD drives, Blu-ray disk drives, redundant array of independent disks (RAID) systems, and DVD drives.

Coded instructions 1332 including the coded instructions of FIG. 11 may be stored in the mass storage device 1328, in the volatile memory 1314, in the non-volatile memory 1316, and/or on a removable tangible computer-readable storage medium such as a CD or DVD.

Figure 14:
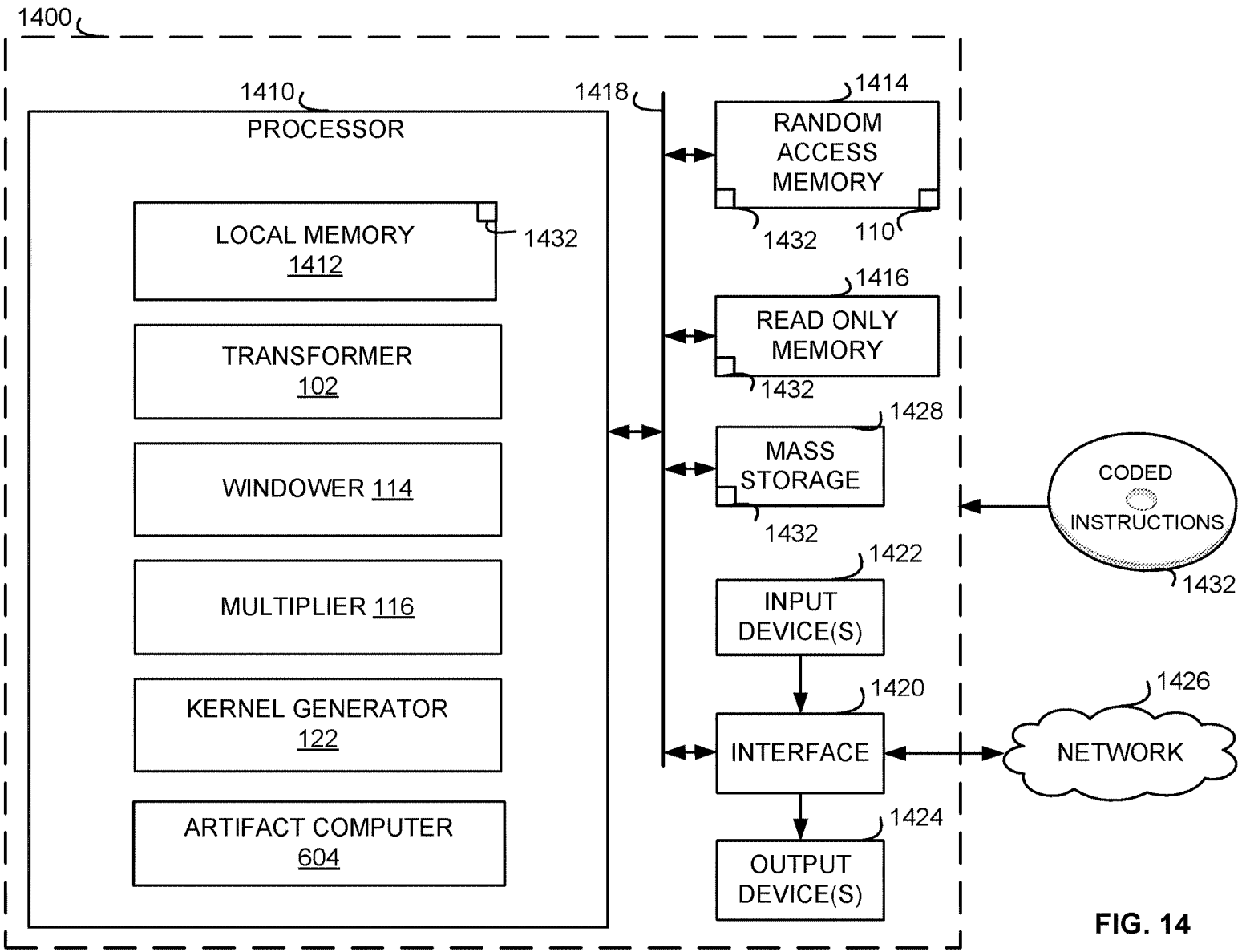
FIG. 14 illustrates an example processor platform structured to execute the example machine-readable instructions of FIG. 4 to implement the example windowed sliding transformer of FIG. 1.

FIG. 14 is a block diagram of an example processor platform 1400 structured to execute the instructions of FIG. 12 to implement the windowed sliding transformer 100 of FIGS. 1 and 2. The processor platform 1400 can be, for example, a server, a personal computer, a workstation, a self-learning machine (e.g., a neural network), a mobile device (e.g., a cell phone, a smart phone, a tablet such as an iPad), a personal digital assistant (PDA), an Internet appliance, a DVD player, a CD player, a digital video recorder, a Blu-ray player, a gaming console, a personal video recorder, a set top box, a headset or other wearable device, or any other type of computing device.

The processor platform 1400 of the illustrated example includes a processor 1410. The processor 1410 of the illustrated example is hardware. For example, the processor 1410 can be implemented by one or more integrated circuits, logic circuits, microprocessors, GPUs, DSPs, or controllers from any desired family or manufacturer. The hardware processor may be a semiconductor based (e.g., silicon based) device. In this example, the processor implements the example transformer 102, the example windower 114, the example multiplier 116, the example kernel generator 122, and the example artifact computer 604.

The processor 1410 of the illustrated example includes a local memory 1412 (e.g., a cache). The processor 1410 of the illustrated example is in communication with a main memory including a volatile memory 1414 and a non-volatile memory 1416 via a bus 1418. The volatile memory 1414 may be implemented by Synchronous Dynamic Random-Access Memory (SDRAM), Dynamic Random-Access Memory (DRAM), RAMBUS® Dynamic Random-Access Memory (RDRAM®) and/or any other type of random access memory device. The non-volatile memory 1416 may be implemented by flash memory and/or any other desired type of memory device. Access to the main memory 1414, 1416 is controlled by a memory controller. In the illustrated example, the volatile memory 1414 implements the buffer 110.

The processor platform 1400 of the illustrated example also includes an interface circuit 1420. The interface circuit 1420 may be implemented by any type of interface standard, such as an Ethernet interface, a universal serial bus (USB), a Bluetooth® interface, a near field communication (NFC) interface, and/or a peripheral component interconnect (PCI) express interface.

In the illustrated example, one or more input devices 1422 are connected to the interface circuit 1420. The input device(s) 1422 permit(s) a user to enter data and/or commands into the processor 1410. The input device(s) can be implemented by, for example, an audio sensor, a microphone, a camera (still or video), a keyboard, a button, a mouse, a touchscreen, a track-pad, a trackball, isopoint and/or a voice recognition system. In some examples, an input device 1422 is used to receive the input signal 106.

One or more output devices 1424 are also connected to the interface circuit 1420 of the illustrated example. The output devices 1424 can be implemented, for example, by display devices (e.g., a light emitting diode (LED), an organic light emitting diode (OLED), a liquid crystal display (LCD), a cathode ray tube display (CRT), an in-place switching (IPS) display, a touchscreen, etc.), a tactile output device, a printer and/or speaker. The interface circuit 1420 of the illustrated example, thus, typically includes a graphics driver card, a graphics driver chip and/or a graphics driver processor.

The interface circuit 1420 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 1426. The communication can be via, for example, an Ethernet connection, a digital subscriber line (DSL) connection, a telephone line connection, a coaxial cable system, a satellite system, a line-of-site wireless system, a cellular telephone system, etc. In some examples, input signals are received via a communication device and the network 1426.

The processor platform 1400 of the illustrated example also includes one or more mass storage devices 1428 for storing software and/or data. Examples of such mass storage devices 1428 include floppy disk drives, hard drive disks, CD drives, Blu-ray disk drives, redundant array of independent disks (RAID) systems, and DVD drives.

Coded instructions 1432 including the coded instructions of FIG. 12 may be stored in the mass storage device 1428, in the volatile memory 1414, in the non-volatile memory 1416, and/or on a removable non-transitory computer-readable storage medium such as a CD-ROM or a DVD.

From the foregoing, it will be appreciated that example methods, apparatus and articles of manufacture have been disclosed that identify sources of network streaming services. From the foregoing, it will be appreciated that methods, apparatus and articles of manufacture have been disclosed which enhance the operations of a computer to improve the correctness of and possibility to identify the sources of network streaming services. In some examples, computer operations can be made more efficient, accurate and robust based on the above techniques for performing source identification of network streaming services. That is, through the use of these processes, computers can operate more efficiently by relatively quickly performing source identification of network streaming services. Furthermore, example methods, apparatus, and/or articles of manufacture disclosed herein identify and overcome inaccuracies and inability in the prior art to perform source identification of network streaming services.

From the foregoing, it will be appreciated that example methods, apparatus and articles of manufacture have been disclosed that lower the complexity and increase the efficiency of sliding windowed transforms. Using teachings of this disclosure, sliding windowed transforms can be computed using the computational benefits of sliding transforms even when a window function is to be implemented. From the foregoing, it will be appreciated that methods, apparatus and articles of manufacture have been disclosed which enhance the operations of a computer by improving the possibility to perform sliding transforms that include the application of window functions. In some examples, computer operations can be made more efficient based on the above equations and techniques for performing sliding windowed transforms. That is, through the use of these processes, computers can operate more efficiently by relatively quickly performing sliding windowed transforms. Furthermore, example methods, apparatus, and/or articles of manufacture disclosed herein identify and overcome inability in the prior art to perform sliding windowed transforms.

Example methods, apparatus, and articles of manufacture to sliding windowed transforms are disclosed herein. Further examples and combinations thereof include at least the following.

Example 1 is an apparatus, comprising a transformer to transform a first block of time-domain samples of an input signal into a first frequency-domain representation based on a second frequency-domain representation of a second block of time-domain samples of the input signal, and a windower to apply a third frequency-domain representation of a time-domain window function to the first frequency-domain representation.

Example 2 is the apparatus of example 1, wherein the windower includes a multiplier to multiply a vector including the first frequency-domain representation and a matrix including the third frequency-domain representation.

Example 3 is the apparatus of example 2, further including a kernel generator to compute the matrix by computing a transform of the time-domain window function.

Example 4 is the apparatus of example 3, wherein the kernel generator is to set a value of a cell of the matrix to zero based on a comparison of the value and a threshold.

Example 5 is the apparatus of any of examples 1 to 4, wherein the transformer computes the first frequency-domain representation based on the second frequency-domain representation using a sliding transform.

Example 6 is the apparatus of any of examples 1 to 5, further including a kernel generator to compute the third frequency-domain representation using a discrete Fourier transform, wherein the transformer computes the first frequency-domain representation based on the second frequency-domain representation using a sliding discrete Fourier transform, and wherein the windower includes a multiplier to multiply a vector including the first frequency-domain representation and a matrix including the third frequency-domain representation.

Example 7 is the apparatus of example 6, wherein the multiplication of the vector and the matrix by the multiplier implements an equivalent of a multiplication of the time-domain window function and the first block of time-domain samples.

Example 8 is the apparatus of any of examples 1 to 7, wherein the time-domain window function includes at least one of a sine window function, a slope window function, or a Kaiser-Bessel-derived window function.

Example 9 a method, comprising transforming a first block of time-domain samples of an input signal into a first frequency-domain representation based on a second frequency-domain representation of a second block of time-domain samples of the input signal, and applying a third frequency-domain representation of a time-domain window function to the first frequency-domain representation.

Example 10 is the method of example 9, wherein the applying the third frequency-domain representation of a time-domain window function to the first frequency-domain representation includes multiplying a vector including the first frequency-domain representation and a matrix including the third frequency-domain representation.

Example 11 is the method of example 10, further including transforming the time-domain window function to the third frequency-domain representation.

Example 12 is the method of example 11, further including setting a value of a cell of the matrix to zero based on a comparison of the value and a threshold.

Example 13 is the method of any of examples 9 to 12, wherein transforming the first block of time-domain into the first frequency-domain representation includes computing a sliding discrete Fourier transform.

Example 14 is the method of any of examples 9 to 13, wherein the time-domain window function includes at least one of a sine window function, a slope window function, or a Kaiser-Bessel-derived window function.

Example 15 is a non-transitory computer-readable storage medium comprising instructions that, when executed, cause a machine to transform a first block of time-domain samples of an input signal into a first frequency-domain representation based on a second frequency-domain representation of a second block of time-domain samples of the input signal, and apply a third frequency-domain representation of a time-domain window function to the first frequency-domain representation.

Example 16 is the non-transitory computer-readable storage medium of example 15, wherein the instructions, when executed, cause the machine to apply the third frequency-domain representation of the time-domain window function to the first frequency-domain representation by multiplying a vector including the first frequency-domain representation and a matrix including the third frequency-domain representation.

Example 17 is the non-transitory computer-readable storage medium of example 16, wherein the instructions, when executed, cause the machine to transform the time-domain window function to the third frequency-domain representation.

Example 18 is the non-transitory computer-readable storage medium of example 17, wherein the instructions, when executed, cause the machine to set a value of a cell of the matrix to zero based on a comparison of the value and a threshold.

Example 19 is the non-transitory computer-readable storage medium of any of examples 15 to 18, wherein the instructions, when executed, cause the machine to transform the first block of time-domain into the first frequency-domain representation by computing a sliding discrete Fourier transform.

Example 20 is the non-transitory computer-readable storage medium of any of examples 15 to 19, wherein the time-domain window function includes at least one of a sine window function, a slope window function, or a Kaiser-Bessel-derived window function.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus, comprising:

a coding format identifier to identify, from a received first audio signal representing a decompressed second audio signal, an audio compression configuration used to compress a third audio signal to form the second audio signal;

a source identifier to identify a source of the second audio signal based on an identified audio compression configuration;

a windowed sliding transformer to perform a first time-frequency analysis of a first block of the first audio signal according to a first trial compression configuration, and perform a second time-frequency analysis of the first block of the first audio signal according to a second trial compression configuration, wherein the windowed sliding transformer includes a multiplier to multiply a vector including a first frequency-domain representation and a matrix including a third frequency-domain representation;

an artifact computer to determine a first compression artifact resulting from the first time-frequency analysis, and determine a second compression artifact resulting from the second time-frequency analysis; and a controller to select between the first trial compression configuration and the second trial compression configuration as the audio compression configuration based on the first compression artifact and the second compression artifact.

2. The apparatus of claim 1, wherein the controller selects between the first trial compression configuration and the second trial compression configuration based on the first compression artifact and the second compression artifact includes comparing the first compression artifact and the second compression artifact.

3. The apparatus of claim 1, wherein:

the windowed sliding transformer performs a third time-frequency analysis of a second block of the first audio signal according to the first trial compression configuration, and performs a fourth time-frequency analysis of the second block of the first audio signal according to the second trial compression configuration;

the artifact computer determines a third compression artifact resulting from the third time-frequency analysis, and determine a fourth compression artifact resulting from the fourth time-frequency analysis; and the controller selects between the first trial compression configuration and the second trial compression configuration as the audio compression configuration based on the first compression artifact, the second compression artifact, the third compression artifact, and the fourth compression artifact.

4. The apparatus of claim 3, further including a post processor to combine the first compression artifact and the third compression artifact to form a first score, and combine the second compression artifact and the fourth compression artifact to form a second score, wherein the controller selects between the first trial compression configuration and the second trial compression configuration as the audio compression configuration by comparing the first score and the second score.

5. The apparatus of claim 4, wherein the post processor combines the first compression artifact and the third compression artifact to form the first score by:

mapping the first compression artifact and a first offset associated with the first compression artifact to a first polar coordinate;

mapping the third compression artifact and a second offset associated with the second compression artifact to a second polar coordinate; and computing the first score as a circular mean of the first polar coordinate and the second polar coordinate.

6. The apparatus of claim 1, wherein the first audio signal is recorded at a media presentation device.

7. The apparatus of claim 1, wherein the windowed sliding transformer includes:

a transformer to transform a first block of time-domain samples of an input signal into a first frequency-domain representation based on a second frequency-domain representation of a second block of time-domain samples of the input signal; and a windower to apply a third frequency-domain representation of a time-domain window function to the first frequency-domain representation.

8. The apparatus of claim 7, wherein the windower includes a multiplier and a matrix.

9. The apparatus of claim 8, further including a kernel generator to compute the matrix by computing a transform of the time-domain window function.

10. The apparatus of claim 9, wherein the kernel generator is to set a value of a cell of the matrix to zero based on a comparison of the value and a threshold.

11. The apparatus of claim 7, wherein the transformer computes the first frequency-domain representation based on the second frequency-domain representation using a sliding transform.

12. A method, comprising:

receiving a first audio signal that represents a decompressed second audio signal;

identifying, from the first audio signal, an audio compression configuration used to compress a third audio signal to form the second audio signal;

applying a windowed sliding transform to the first audio signal to identify an audio compression configuration used to compress a third audio signal to form the second audio signal, wherein the applying the windowed sliding transform includes multiplying a vector including a first frequency-domain representation and a matrix including a third frequency-domain representation;

identifying a coding format based on the identified audio compression configuration; and identifying a source of the second audio signal based on the identified audio compression configuration.

13. The method of claim 12, wherein applying the windowed sliding transform includes:

transforming a first block of time-domain samples of an input signal into a first frequency-domain representation based on a second frequency-domain representation of a second block of time-domain samples of the input signal; and applying a third frequency-domain representation of a time-domain window function to the first frequency-domain representation.

14. The method of claim 13, wherein the applying the third frequency-domain representation of a time-domain window function to the first frequency-domain representation includes multiplying a vector and a matrix.

15. The method of claim 14, further including transforming the time-domain window function to the third frequency-domain representation.

16. The method of claim 15, wherein transforming the first block of time-domain into the first frequency-domain representation includes computing a sliding discrete Fourier transform.

17. A non-transitory computer-readable storage medium comprising instructions that, when executed, cause a machine to at least:

receive a first audio signal that represents a decompressed second audio signal;

identify, from the first audio signal, an audio compression configuration used to compress a third audio signal to form the second audio signal;

apply a windowed sliding transform to the first audio signal to identify an audio compression configuration used to compress a third audio signal to form the second audio signal, wherein the windowed sliding transform is to multiply a vector including a first frequency-domain representation and a matrix including a third frequency-domain representation;

identify a coding format based on the identified audio compression configuration; and identify a source of the second audio signal based on the identified audio compression configuration.

18. The non-transitory computer-readable storage medium of claim 17, wherein the instructions, when executed, cause the machine to:

transform a first block of time-domain samples of an input signal into a first frequency-domain representation based on a second frequency-domain representation of a second block of time-domain samples of the input signal; and applying a third frequency-domain representation of a time-domain window function to the first frequency-domain representation.

19. The non-transitory computer-readable storage medium of claim 18, wherein the instructions, when executed, cause the machine to transform the first block of time-domain into the first frequency-domain representation by computing a sliding discrete Fourier transform.

* * * * *